US011779176B2

(12) United States Patent
Krebs et al.

(10) Patent No.: US 11,779,176 B2
(45) Date of Patent: Oct. 10, 2023

(54) SELF-CLEANING SYSTEM AND METHOD FOR EXTRACTION CLEANERS

(71) Applicant: BISSELL Inc., Grand Rapids, MI (US)

(72) Inventors: Alan J. Krebs, Pierson, MI (US); Kenneth M. Lenkiewicz, Grand Rapids, MI (US); Scott Miller Vogel, Grand Rapids, MI (US); Aaron P. Griffith, Grand Rapids, MI (US); Eric Daniel Buehler, Grand Rapids, MI (US); Jeffrey A. Scholten, Ada, MI (US); Jake Boles, Kentwood, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/880,824

(22) Filed: Aug. 4, 2022

(65) Prior Publication Data

US 2022/0378260 A1 Dec. 1, 2022

Related U.S. Application Data

(63) Continuation of application No. 15/994,040, filed on May 31, 2018, now Pat. No. 11,439,283.

(60) Provisional application No. 62/514,095, filed on Jun. 2, 2017.

(51) Int. Cl.

| | |
|---|---|
| ***A47L 7/00*** | (2006.01) |
| ***A47L 11/40*** | (2006.01) |
| ***A47L 11/292*** | (2006.01) |
| ***A47L 9/00*** | (2006.01) |
| ***A47L 11/30*** | (2006.01) |

(52) U.S. Cl.

CPC ..... *A47L 7/0052* (2013.01); *A47L 7/0009* (2013.01); *A47L 9/0063* (2013.01); *A47L 11/292* (2013.01); *A47L 11/302* (2013.01); *A47L 11/40* (2013.01); *A47L 11/4083* (2013.01)

(58) Field of Classification Search

CPC ..... A47L 11/24; A47L 11/4083; A47L 11/40; A47L 11/302; A47L 11/292; A47L 9/0063; A47L 7/0009; A47L 7/0057; A47L 7/0052

USPC ..... 134/1; 15/246.2, 52.1, 49.1

See application file for complete search history.

(56) References Cited

U.S. PATENT DOCUMENTS

| | | | |
|---|---|---|---|
| D704,628 | S | 5/2014 | Tajik et al. |
| 8,819,882 | B2 | 9/2014 | De Wit et al. |
| 8,925,142 | B2 | 1/2015 | Orubor |
| 9,289,105 | B2 | 3/2016 | Moes |
| D809,232 | S | 1/2018 | Wu |
| 10,092,155 | B2 | 10/2018 | Xia et al. |
| 10,813,514 | B2 | 10/2020 | Jang et al. |

(Continued)

FOREIGN PATENT DOCUMENTS

| | | |
|---|---|---|
| CN | 201658322 U | 12/2010 |
| CN | 207384228 U | 5/2018 |

(Continued)

*Primary Examiner* — Katina N. Henson

(74) *Attorney, Agent, or Firm* — WARNER NORCROSS + JUDD LLP

(57) ABSTRACT

A cleaning tray is provided for docking an extraction cleaner, including upright or robot extraction cleaners, for self-cleaning. The cleaning tray may include one or more sprayers for spraying a cleaning fluid toward a suction nozzle, brush chamber, and/or agitator of the extraction cleaner. Systems for self-cleaning extraction cleaners are also provided.

20 Claims, 22 Drawing Sheets

(56) References Cited

U.S. PATENT DOCUMENTS

| | | | |
|---|---|---|---|
| 11,141,035 | B2 | 10/2021 | Zhang |
| 2005/0015916 | A1 | 1/2005 | Orubor |
| 2016/0270620 | A1 | 9/2016 | Miller et al. |
| 2016/0338558 | A1* | 11/2016 | Wood ..... B08B 5/04 |
| 2017/0071434 | A1 | 3/2017 | Nguyen |
| 2017/0119225 | A1 | 5/2017 | Xia et al. |
| 2018/0344112 | A1 | 12/2018 | Krebs et al. |

FOREIGN PATENT DOCUMENTS

| | | | |
|---|---|---|---|
| DE | 102008018511 | A1 | 10/2009 |
| EP | 2484261 | A1 | 8/2012 |
| JP | 4005940 | B2 | 11/2007 |
| WO | 2013113395 | A1 | 8/2013 |

* cited by examiner

SELF-CLEANING SYSTEM AND METHOD FOR EXTRACTION CLEANERS

CROSS REFERENCE TO RELATED APPLICATION(S)

This application is a continuation of U.S. patent application Ser. No. 15/994,040, filed May 31, 2018, which claims the benefit of U.S. Provisional Patent Application No. 62/514,095, filed Jun. 2, 2017, both of which are incorporated herein by reference in their entirety.

BACKGROUND

Extraction cleaners are well-known surface cleaning apparatuses for deep cleaning carpets and other fabric surfaces, such as upholstery. Most extraction cleaners, or deep cleaners, comprise a fluid delivery system that delivers cleaning fluid to a surface to be cleaned and a fluid recovery system that extracts spent cleaning fluid and debris (which may include dirt, dust, stains, soil, hair, and other debris) from the surface. The fluid delivery system typically includes one or more fluid supply containers for storing a supply of cleaning fluid, a fluid distributor for applying the cleaning fluid to the surface to be cleaned, and a fluid supply conduit for delivering the cleaning fluid from the fluid supply container to the fluid distributor. An agitator can be provided for agitating the cleaning fluid on the surface. The fluid recovery system usually comprises a recovery container, a nozzle adjacent the surface to be cleaned and in fluid communication with the recovery container through a working air conduit, and a source of suction in fluid communication with the working air conduit to draw the cleaning fluid from the surface to be cleaned and through the nozzle and the working air conduit to the recovery container.

Many extraction cleaners for household use are uprights, and include a base and an upright body having a handle for directing the base across the surface to be cleaned. Some extraction cleaners have been provided as autonomous robots, which carry the systems on an autonomously-moveable unit.

BRIEF SUMMARY

An aspect of the present disclosure relates to a cleaning tray for an extraction cleaner having a fluid delivery system, a suction nozzle, a brush chamber, and an agitator, the cleaning tray including a tray body, a plurality of spray nozzles on the tray body, and a fluid delivery pathway supplying cleaning fluid to the plurality of spray nozzles, the fluid delivery pathway comprising an inlet configured to fluidly couple with the fluid delivery system of the extraction cleaner, wherein a portion of the fluid delivery pathway is one of formed in and mounted to the tray body.

In another aspect, the present disclosure relates to a self-cleaning cleaning system including an extraction cleaner apparatus comprising a fluid delivery system, a suction nozzle, a brush chamber, and an agitator, and a cleaning tray. The cleaning tray includes a tray body, a plurality of spray nozzles on the tray body, and a fluid delivery pathway supplying cleaning fluid to the plurality of spray nozzles, the fluid delivery pathway comprising an inlet configured to fluidly couple with the fluid delivery system of the extraction cleaner, wherein a portion of the fluid delivery pathway is one of formed in and mounted to the tray body. The extraction cleaner may be an upright or robot extraction cleaner.

DETAILED DESCRIPTION

The disclosure generally relates to features and improvements for extraction cleaners for floor surfaces that have fluid delivery and recovery capabilities. In particular, the features and improvements relate to cleaning and maintaining such extraction cleaners.

Figure 1:
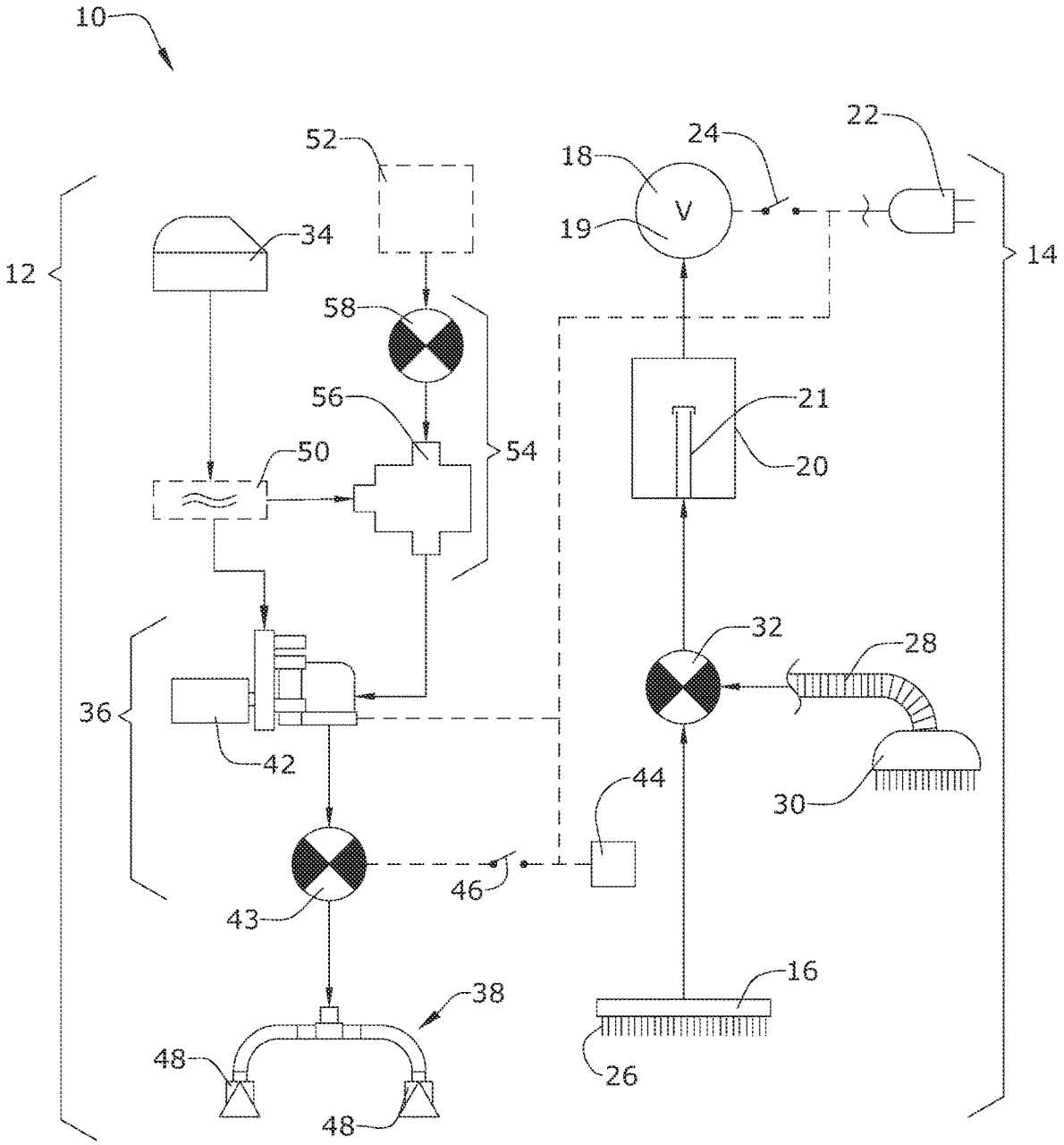
FIG. 1 is a schematic view of an exemplary extraction surface cleaning apparatus.

FIG. 1 is a schematic view of various functional systems of a surface cleaning apparatus in the form of an extraction cleaner 10. The functional systems of the extraction cleaner 10 can be arranged into any desired configuration, such as an upright extraction device having a base and an upright body for directing the base across the surface to be cleaned, a canister device having a cleaning implement connected to a wheeled base by a vacuum hose, a portable extractor adapted to be hand carried by a user for cleaning relatively small areas, or a commercial extractor. Any of the aforementioned extraction cleaners can be adapted to include a flexible vacuum hose, which can form a portion of the working air conduit between a nozzle and the suction source.

The extraction cleaner 10 can include a fluid delivery system 12 for storing cleaning fluid and delivering the cleaning fluid to the surface to be cleaned and a recovery system 14 for removing the spent cleaning fluid and debris from the surface to be cleaned and storing the spent cleaning fluid and debris.

The recovery system 14 can include a suction nozzle 16, a suction source 18 in fluid communication with the suction nozzle 16 for generating a working air stream, and a recovery container 20 for separating and collecting fluid and debris from the working airstream for later disposal. A separator 21 can be formed in a portion of the recovery container 20 for separating fluid and entrained debris from the working airstream.

The suction source 18 is provided in fluid communication with the recovery container 20. The suction source is illustrated herein as a motor/fan assembly 19 that can be electrically coupled to a power source 22, such as a battery or by a power cord plugged into a household electrical outlet. A suction power switch 24 between the motor/fan assembly 19 and the power source 22 can be selectively closed by the user, thereby activating the motor/fan assembly 19.

The suction nozzle 16 can be provided on a base or cleaning head adapted to move over the surface to be cleaned. An agitator 26 can be provided adjacent to the suction nozzle 16 for agitating the surface to be cleaned so that the debris is more easily ingested into the suction nozzle 16. Some examples of agitators include, but are not limited to, a horizontally-rotating brushroll, dual horizontally-rotating brushrolls, one or more vertically-rotating brushrolls, or a stationary brush.

The extraction cleaner 10 can also be provided with above-the-floor cleaning features. An accessory hose 28 can be selectively fluidly coupled to the motor/fan assembly 19 for above-the-floor cleaning using an above-the floor accessory tool 30 with its own suction inlet. A diverter assembly 32 can be selectively switched between on-the-floor and above-the floor cleaning by diverting fluid communication between either the suction nozzle 16 or the accessory hose 28 with the motor/fan assembly 19. The accessory hose 28 can also communicate with the fluid delivery system 12 to selectively deliver cleaning fluid.

The fluid delivery system 12 can include at least one fluid container 34 for storing a supply of fluid. The fluid can comprise one or more of any suitable cleaning fluids, including, but not limited to, water, compositions, concentrated detergent, diluted detergent, etc., and mixtures thereof. For example, the fluid can comprise a mixture of water and concentrated detergent.

The fluid delivery system 12 can further comprise a flow control system 36 for controlling the flow of fluid from the supply container 34 to at least one fluid distributor 38. In one configuration, the flow control system 36 can comprise a pump 40 which pressurizes the system 12 and a flow control valve 42 which controls the delivery of fluid to the distributor 38. An actuator 44 can be provided to actuate the flow control system 36 and dispense fluid to the distributor 38. The actuator 44 can be operably coupled to the valve 42 such that pressing the actuator 44 will open the valve 42. The valve 42 can be electrically actuated, such as by providing an electrical switch 46 between the valve 42 and the power source 22 that is selectively closed when the actuator 44 is pressed, thereby powering the valve 42 to move to an open position. In one example, the valve 42 can be a solenoid valve. The pump 40 can also be coupled with the power source 22. In one example, the pump 40 can be a centrifugal pump. In another example, the pump 40 can be a solenoid pump.

The fluid distributor 38 can include at least one distributor outlet 48 for delivering fluid to the surface to be cleaned. The at least one distributor outlet 48 can be positioned to deliver fluid directly to the surface to be cleaned, or indirectly by delivering fluid onto the agitator 26. The at least one distributor outlet 48 can comprise any structure, such as a nozzle or spray tip; multiple outlets 48 can also be provided. As illustrated in FIG. 1, the distributor 38 can comprise multiple sprayers 48 which distribute cleaning fluid to the surface to be cleaned. For above-the-floor cleaning, the cleaning tool 30 can include an auxiliary distributor (not shown) coupled with the fluid delivery system 12.

Optionally, a heater 50 can be provided for heating the cleaning fluid prior to delivering the cleaning fluid to the surface to be cleaned. In the example illustrated in FIG. 1, an in-line heater 50 can be located downstream of the container 34 and upstream of the pump 40. Other types of heaters 50 can also be used. In yet another example, the cleaning fluid can be heated using exhaust air from a motor-cooling pathway for the motor/fan assembly 19.

As another option, the fluid delivery system can be provided with an additional container 52 for storing a cleaning fluid. For example, the first container 34 can store water and the second container 52 can store a cleaning agent such as detergent. The containers 34, 52 can, for example, be defined by a supply tank and/or a collapsible bladder. In one configuration, the first container 34 can be a bladder that is provided within the recovery container 20. Alternatively, a single container can define multiple chambers for different fluids.

In the case where multiple containers 34, 52 are provided, the flow control system 36 can further be provided with a mixing system 54 for controlling the composition of the cleaning fluid that is delivered to the surface. The composition of the cleaning fluid can be determined by the ratio of cleaning fluids mixed together by the mixing system. As shown herein, the mixing system 54 includes a mixing manifold 56 that selectively receives fluid from one or both of the containers 34, 52. A mixing valve 58 is fluidly coupled with an outlet of the second container 52, whereby when mixing valve 58 is open, the second cleaning fluid will flow to the mixing manifold 56. By controlling the orifice of the mixing valve 58 or the time that the mixing valve 58 is open, the composition of the cleaning fluid that is delivered to the surface can be selected.

In yet another configuration of the fluid delivery system 12, the pump 40 can be eliminated and the flow control system 36 can comprise a gravity-feed system having a valve fluidly coupled with an outlet of the container(s) 34, 52, whereby when valve is open, fluid will flow under the force of gravity to the distributor 38. The valve can be mechanically actuated or electrically actuated, as described above.

The extraction cleaner 10 shown in FIG. 1 can be used to effectively remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the disclosure.

In operation, the extraction cleaner 10 is prepared for use by coupling the extraction cleaner 10 to the power source 22, and by filling the first container 34, and optionally the second container 52, with cleaning fluid. Cleaning fluid is selectively delivered to the surface to be cleaned via the fluid delivery system 12 by user-activation of the actuator 44, while the extraction cleaner 10 is moved back and forth over the surface. The agitator 26 can simultaneously agitate the cleaning fluid into the surface to be cleaned. During operation of the recovery system 14, the extraction cleaner 10 draws in fluid and debris-laden working air through the suction nozzle 16 or cleaning tool 30, depending on the position of the diverter assembly 32, and into the downstream recovery container 20 where the fluid debris is substantially separated from the working air. The airstream then passes through the motor/fan assembly 19 prior to being exhausted from the extraction cleaner 10. The recovery container 20 can be periodically emptied of collected fluid and debris.

Figure 2:
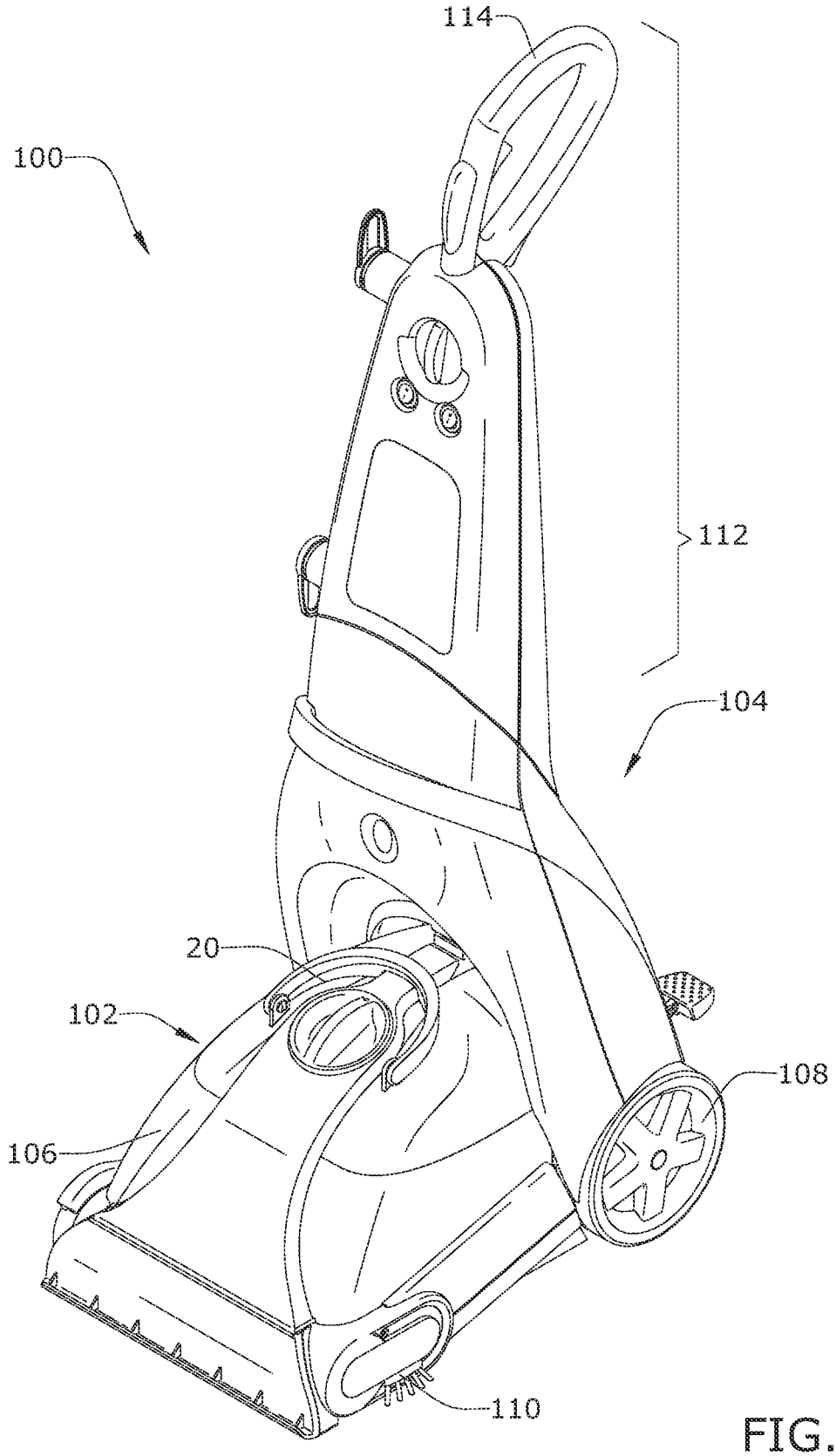
FIG. 2 is a perspective view of the extraction surface cleaning apparatus of FIG. 1 in the form of an upright extraction cleaner according to various aspects described herein.

FIG. 2 is a perspective view of a surface cleaning apparatus in the form of an upright deep cleaner or extraction cleaner 100 according to various aspects described herein. The upright extraction cleaner can incorporate the systems and components shown in FIG. 1, including the fluid delivery system 12 for storing and delivering a cleaning fluid to the surface to be cleaned and the recovery system 14 for extracting and storing the dispensed cleaning fluid, dirt and debris from the surface to be cleaned. As illustrated herein, the extraction cleaner 100 is an upright extraction cleaner having a housing that includes an upright assembly 102 that is pivotally connected to a base assembly 104 for directing the base assembly 104 across the surface to be cleaned.

For purposes of description related to the figures, the terms "upper," "lower," "right," "left," "rear," "front," "vertical," "horizontal," "inner," "outer," and derivatives thereof shall relate to the extraction cleaner 100 as oriented in FIG. 2 from the perspective of a user behind the extraction cleaner 100, which defines the rear of the extraction cleaner 100. However, it is to be understood that the disclosure may assume various alternative orientations, except where expressly specified to the contrary.

The various systems and components schematically described for FIG. 1, including the fluid delivery system 12 and fluid recovery system 14 can be supported by either or both the base assembly and the upright assembly. The base assembly 104 has been illustrated as including a base housing 106 supporting components of the fluid delivery system 12 and the recovery system 14, including, but not limited to, the suction nozzle 16, the agitator 26, the pump 40, and at least one fluid distributor 38. The base assembly 104 can also support the recovery container 20 at a forward portion thereof, forward being defined as relative to the mounting location of the upright assembly 102 on the base assembly 104, and the fluid container or supply tank, which is not visible in FIG. 2, at a rearward portion thereof. Wheels 108 at least partially support the base housing for movement over the surface to be cleaned. An additional agitator in the form of stationary edge brushes 110 may also be provided on the base housing. The motor/fan assembly 19 (FIG. 1) can also be positioned within the base assembly 104, in fluid communication with the recovery container 20. The upright assembly 102 has an elongated housing 112 extending upwardly from base assembly 104 that is provided with a hand grip 114 at one end that can be used for maneuvering the extraction cleaner 100 over a surface to be cleaned. The elongated housing 112 can store an accessory hose 116 (shown in FIG. 3) when not in use for above-the-floor cleaning. Additional details of the extraction cleaner 100 are disclosed in U.S. Pat. No. 7,784,148, which is incorporated herein by reference in its entirety.

Figure 3:
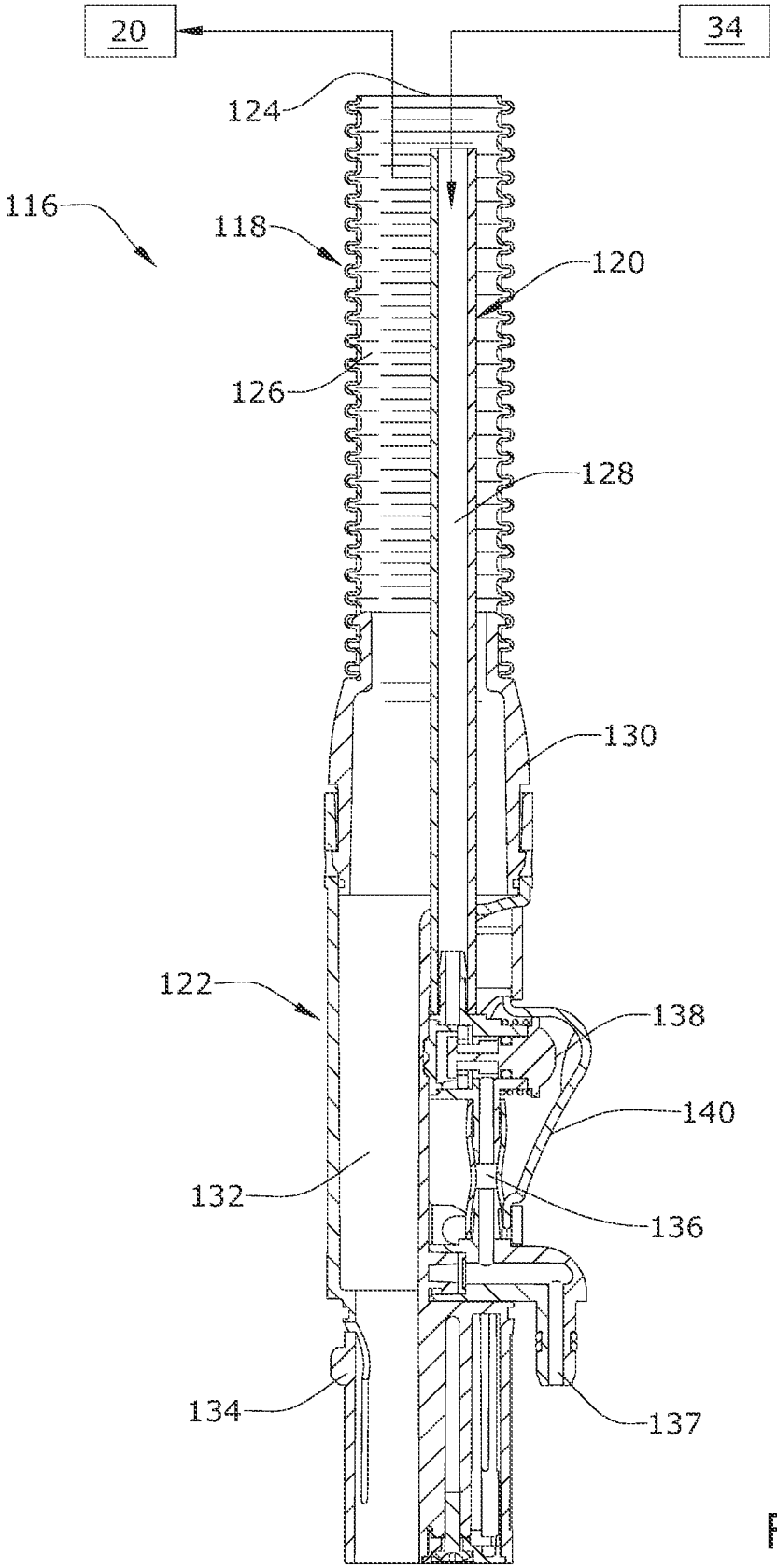
FIG. 3 is a cross-sectional view through an accessory hose of the extraction cleaner of FIG. 2.

FIG. 3 illustrates that the accessory hose 28 includes a flexible hose conduit 118, a flexible fluid delivery conduit 120, a hose coupler (not shown) at one end of the hose conduit 118 which couples to the extraction cleaner 100 to place the hose in fluid communication with the fluid delivery and recovery systems 12, 14, and a wand 122 at the opposite end of the hose conduit 118 for selectively coupling an accessory tool, such as cleaning tool 30 shown in FIG. 1. The wand 122 defines an inlet 124 of the accessory hose 116. Only a portion of the length of the hose conduit 118 is shown in FIG. 3 for clarity, as indicated by the break lines through the hose conduit 118.

The flexible hose conduit 118 can define an airflow pathway 126 and can carry the flexible fluid delivery conduit 120 within the airflow pathway 126. Alternatively, the fluid delivery conduit 120 can extend externally to the airflow pathway 126. The airflow pathway 126 is configured to be coupled with the recovery container 20, and the fluid delivery conduit 120, which defines a fluid delivery pathway 128, is configured to be coupled with the supply container 34.

The wand 122 includes a housing 130 with an airflow pathway 132 having an airflow connector 134 which fluidly couples with the airflow pathway 126 of the hose conduit 118, and a fluid delivery pathway 136 having a fluid connector 137 which fluidly couples with the fluid delivery pathway 128 of the delivery conduit 120. A valve 138 can be provided in the fluid delivery pathway 136 for controlling the flow of cleaning fluid to the fluid connector 137. The valve 138 can be controlled by the user via a valve actuator, such as a trigger 140 provided on the housing of the wand 122.

Figure 4:
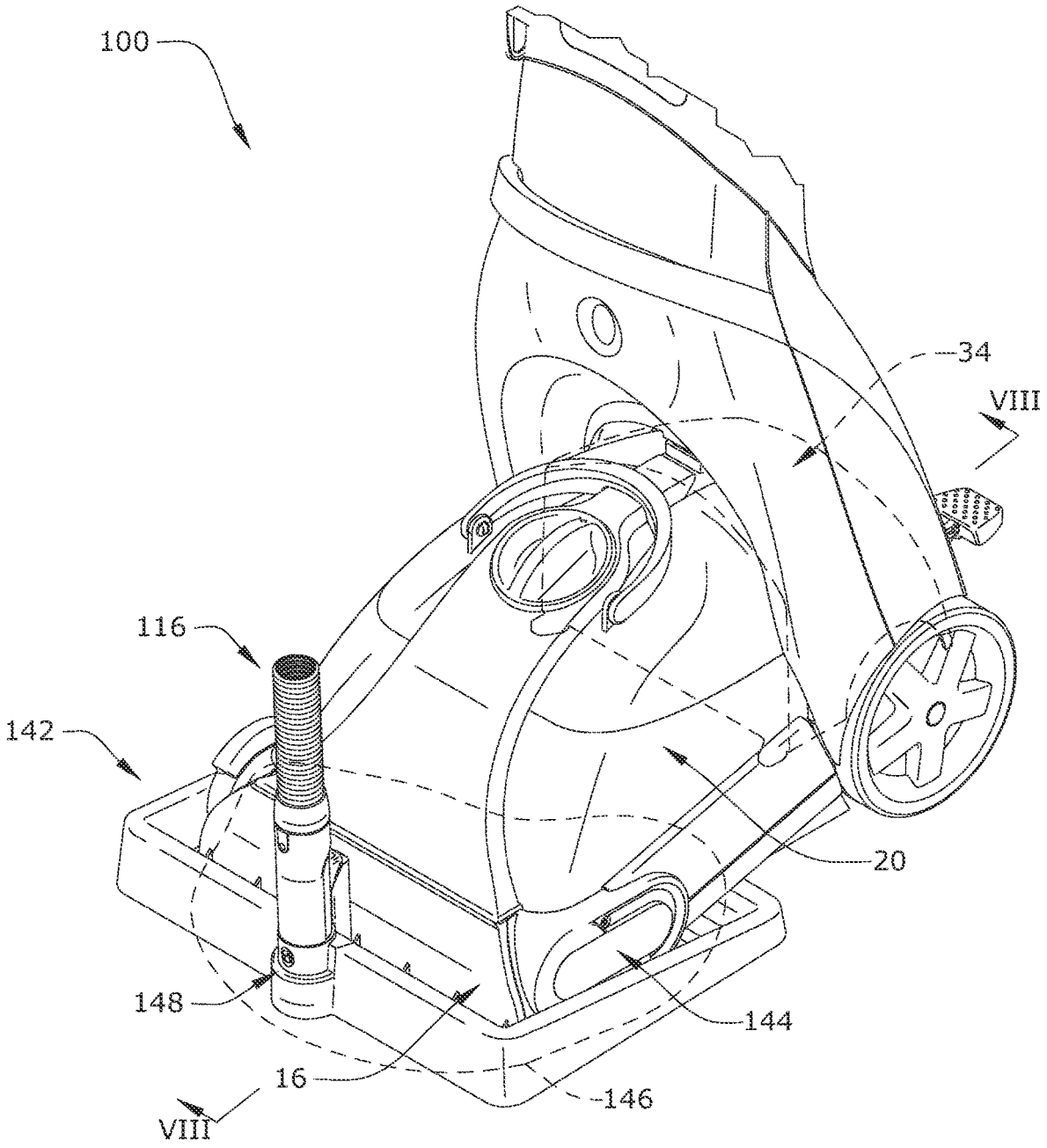
FIG. 4 is a perspective view of the extraction cleaner of FIG. 2 docked with a cleaning tray according to various aspects described herein.

FIG. 4 is a perspective view of the extraction cleaner of FIG. 2 docked with a body forming a cleaning tray 142 according to non-limiting aspects of the disclosure. Upright extraction cleaners can get very dirty, particularly in the brush chamber and extraction pathway, and can be difficult for the user to clean. A self-cleaning system and method using the cleaning tray shown in FIG. 4 is provided for the extraction cleaner 100, which saves the user considerable time and may lead to more frequent use of the extraction cleaner 100.

The extraction cleaner 100 can have an integrated self-cleaning cycle configured to be run when the extraction cleaner 100 is docked with the cleaning tray 142 as shown in FIG. 4. The cleaning tray 142 is configured to at least partially surround at least one of the suction nozzle 16 and agitator 26. More specifically, the cleaning tray 142 can create a sealed cleaning pathway 146 between a brush chamber 144 and suction nozzle 16 when installed. The user can then engage the self-cleaning cycle, which washes out the brush chamber 144 via the sealed cleaning pathway 146. The self-cleaning cycle can utilize the accessory hose 116 discussed for FIG. 3 in addition to the cleaning tray 142.

Figure 5:
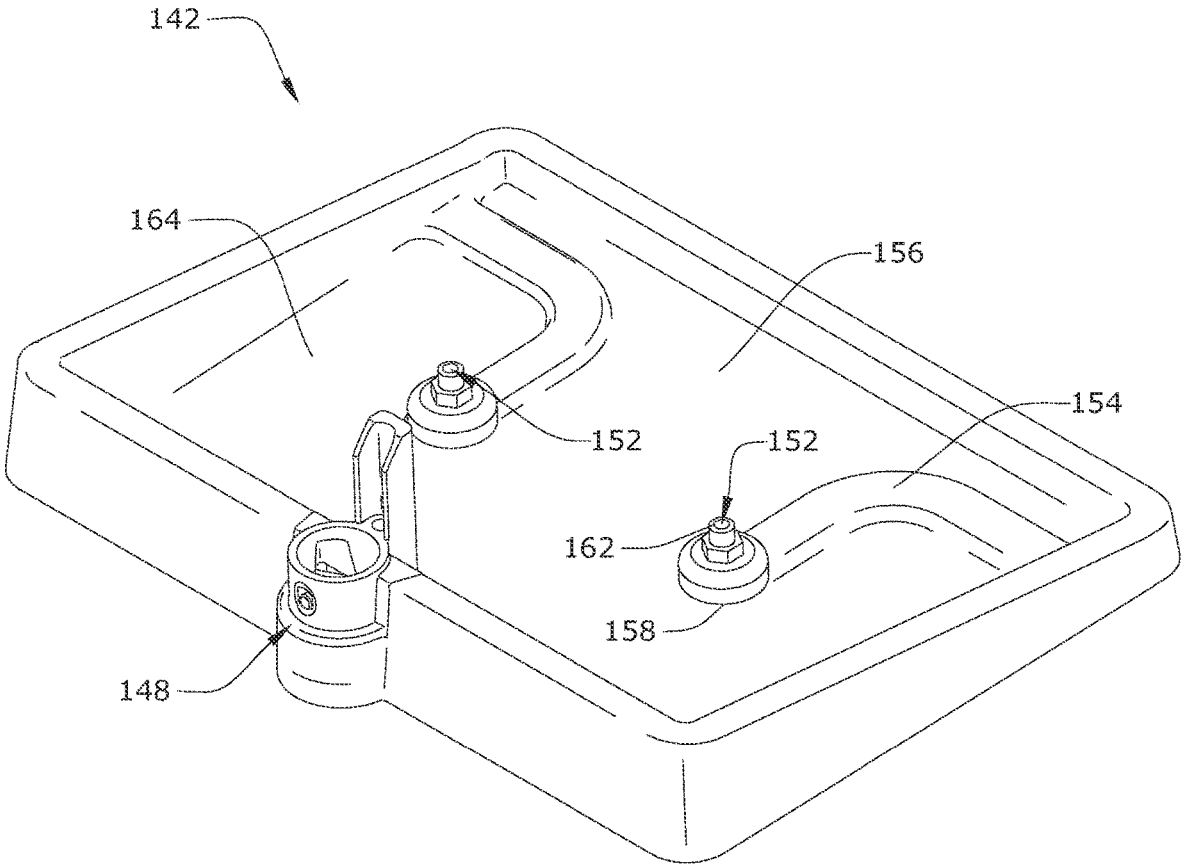
FIG. 5 is a front perspective view of the cleaning tray from FIG. 4.
Figure 6:
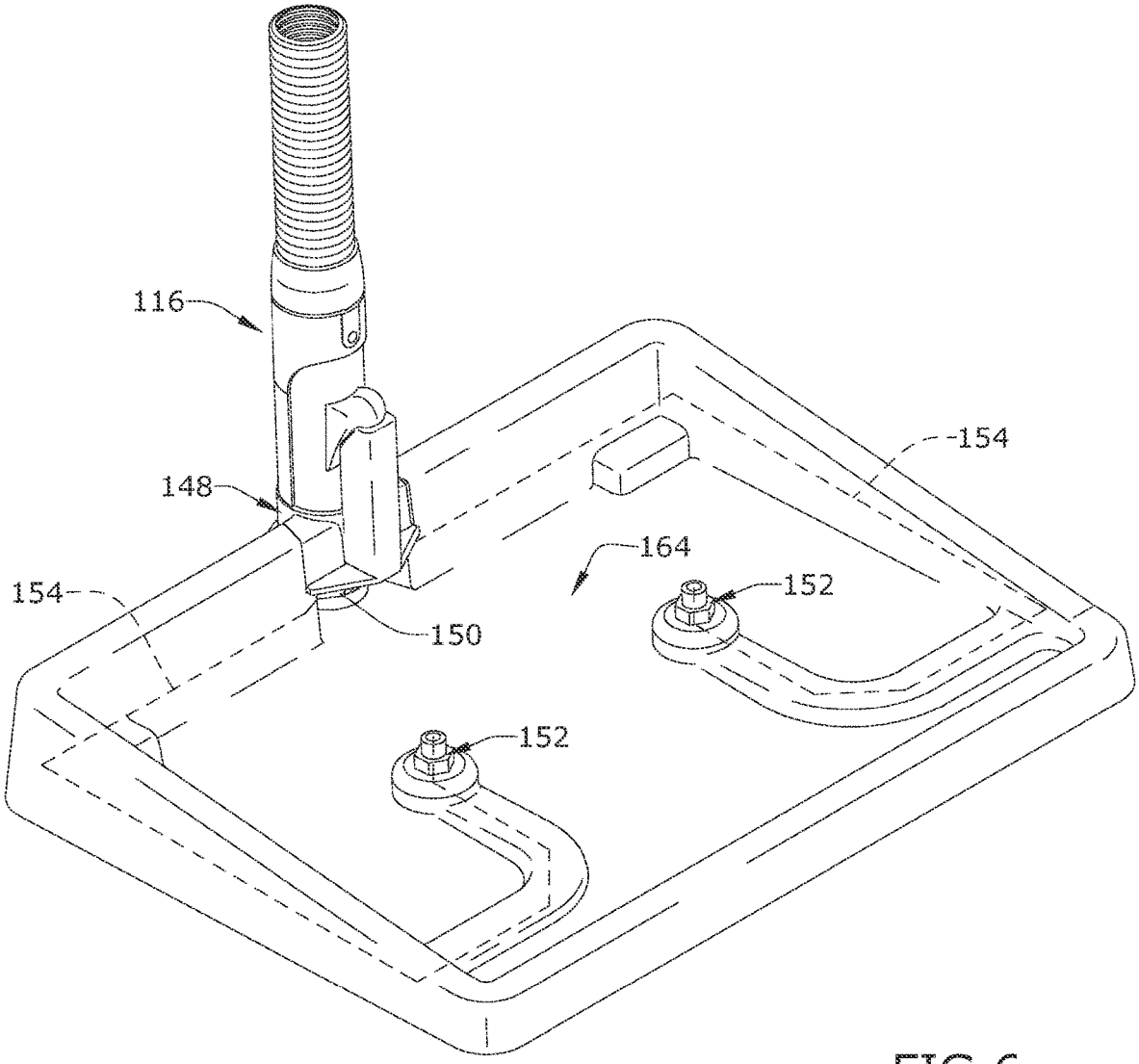
FIG. 6 is a rear perspective view of the cleaning tray from FIG. 4, with the accessory hose attached to the tray.
Figure 7:
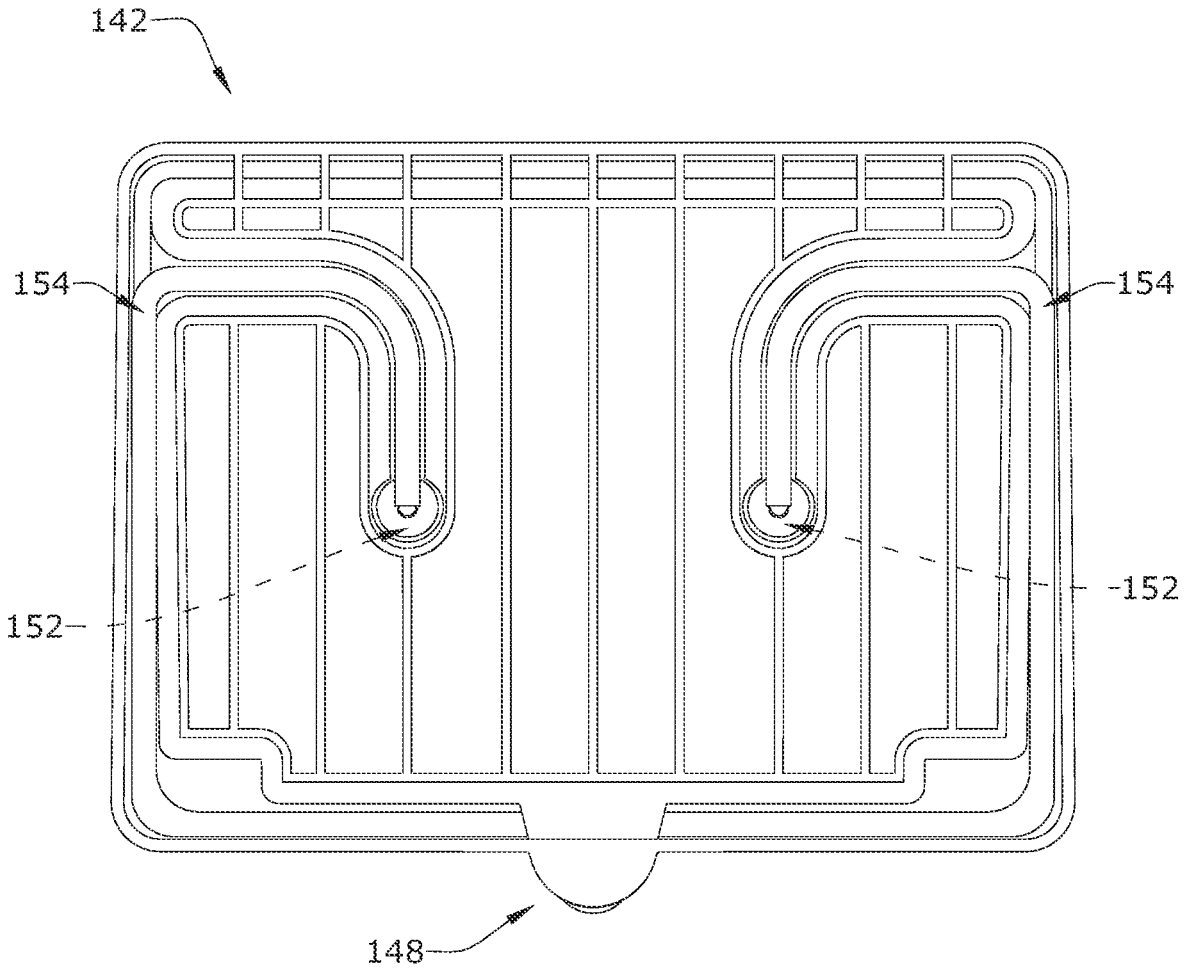
FIG. 7 is a bottom view of the cleaning tray from FIG. 4.

Referring to FIGS. 5-7, the tray 142 is configured to support a portion of the extraction cleaner 100 thereon, and includes a hose receiver 148 at one end for fluidly coupling with the accessory hose 116, which is coupled at the opposite end with the extraction cleaner 100 as described above, and a fluid delivery manifold 150 fluidly connected to the hose receiver 148 at one end. The tray 142 also includes one or more upward facing spray nozzles 152 fluidly connected to the manifold 150. The manifold 150 can include multiple conduits 154 extending from the hose receiver 148 to multiple spray nozzles 152. As shown two conduits 154 extend from the hose receiver 148 along a bottom side 156 of the tray 142, and each has an outlet 158 fluidly coupled with a spray nozzle 152. The illustrated conduits 154 are flexible hoses fastened within a channel 160 on the bottom of the tray 142. Alternatively, integrally-molded conduits 154 can be provided within the tray 142 itself. The spray nozzles 152 have at least one spray nozzle outlet 162 oriented to direct a spray of cleaning fluid upwardly. It is contemplated that the tray 142 can form a reservoir 164 which collects sprayed cleaning fluid.

Figure 8:
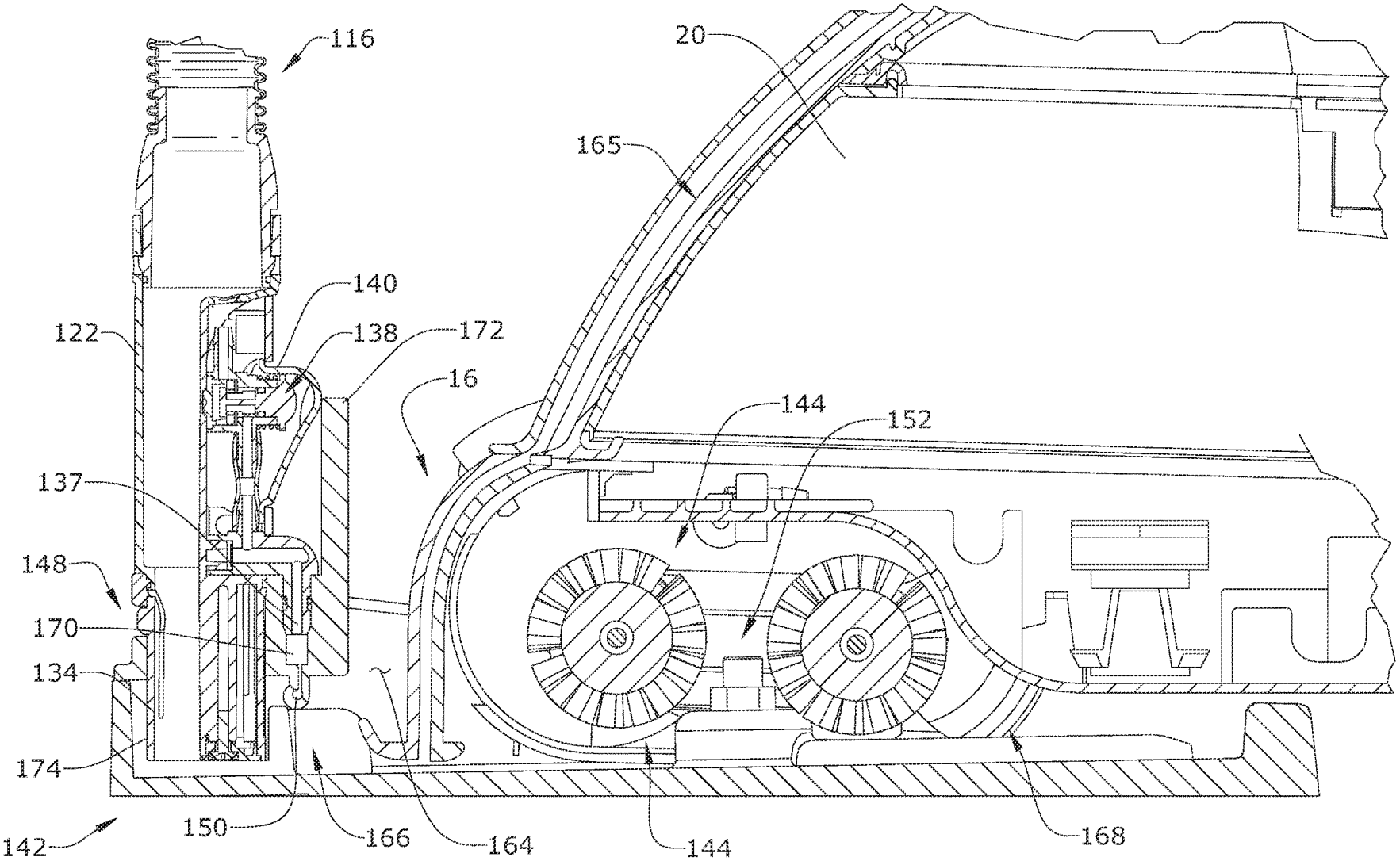
FIG. 8 is a cross-sectional view taken through line VIII-VIII of FIG. 4.

FIG. 8 is a cross-sectional view of the extraction cleaner docked with the cleaning tray. The reservoir 164 of the tray 142 holds the collected cleaning fluid in the vicinity of the suction nozzle 16, whereby the suction nozzle 16 can draw the collected cleaning fluid into the recovery container 20. This also serves to flush out a recovery pathway 165 between the suction nozzle 16 and the recovery container 20. It is noted that the suction nozzle 16, rather than the hose 116, is in fluid communication with the motor/fan assembly 19 (FIG. 1) during self-cleaning; for example, the diverter assembly 32 (FIG. 1) of the extraction cleaner 100 is switched to on-the-floor cleaning.

The tray 142 can be configured to physically support a portion of the extraction cleaner 100 in engagement with the collection reservoir 164, and can include a forward support 166 for engaging the front of the suction nozzle 16 and a rearward support 168 which engages the bottom of the base housing 106 behind the brush chamber 144. The tray 142 can also be used when storing the extraction cleaner 100 after use or self-cleaning, and can catch any drips from the extraction cleaner 100.

The front portion of the base housing 106 of the extraction cleaner 100, which includes at least the suction nozzle 16 and the brush chamber 144, rests on top of the tray 142 in the illustrated example.

The hose receiver 148 includes a fluid connector coupler 170 in fluid communication with the manifold 150 that receives the fluid connector 137 of the hose 116. A trigger actuator 172 is associated with the fluid connector coupler 170, and is configured to depress the trigger 140 when the fluid connector 137 is received in the coupler 170. Receipt of the fluid connector 137 in the fluid connector coupler 170 thereby simultaneously places the fluid connector 137 in fluid communication with the manifold 150 and opens the valve 138 to open the fluid delivery pathway 128. The hose receiver 148 further includes an airflow connector coupler 174 that receives the airflow connector 134 of the hose 116 to support the hose 116 in a substantially upright position on the tray 142.

Figure 9:
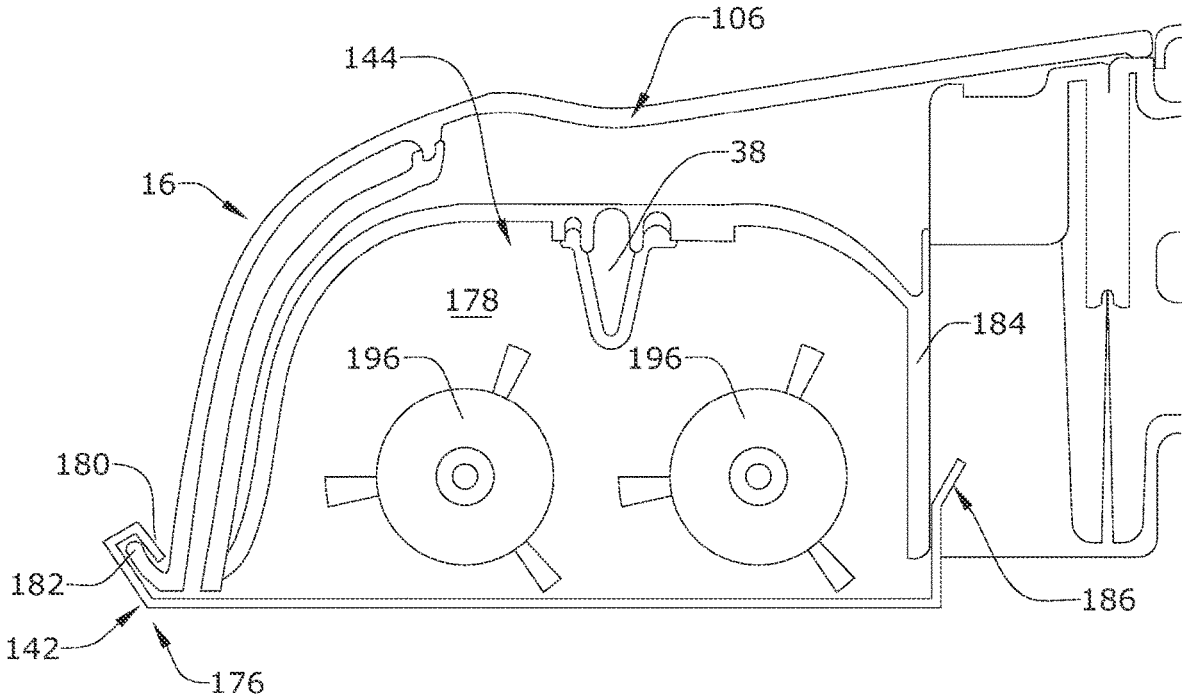
FIG. 9 is a cross-sectional view through the extraction cleaner of FIG. 2 docked with another cleaning tray according to various aspects described herein.

Alternatively, FIG. 9 illustrates that the tray 142 can be configured as a snap-fit cover 176, similar to a lid of a plastic storage container, which mounts to the bottom of the base housing 106 and encloses the brush chamber 144 and suction nozzle 16, thereby creating a cleaning chamber 178 for flushing the suction nozzle 16 and brush chamber 144. The tray 142 can comprise a retainer such as a hook 180 on a forward portion that is configured to mount to a corresponding feature on the suction nozzle 16, such as a mounting lip 182, on a lower, forward portion of the base housing 106. The tray 142 can further comprise flexible, resilient vertical walls 184 that can be press fit onto the base housing 106 for sealing around the perimeter of the base housing 106. A rear portion of the tray 142 can comprise a pull tab 186 for releasing the tray 142 from the base housing 106. A user can apply downward force on the pull tab 186 to slide the vertical walls 184 off the base housing 106 while pivoting the tray 142 about the hook 180 to disengage the mounting lip 182 and remove the tray 142 from the base housing 106.

Figure 10:
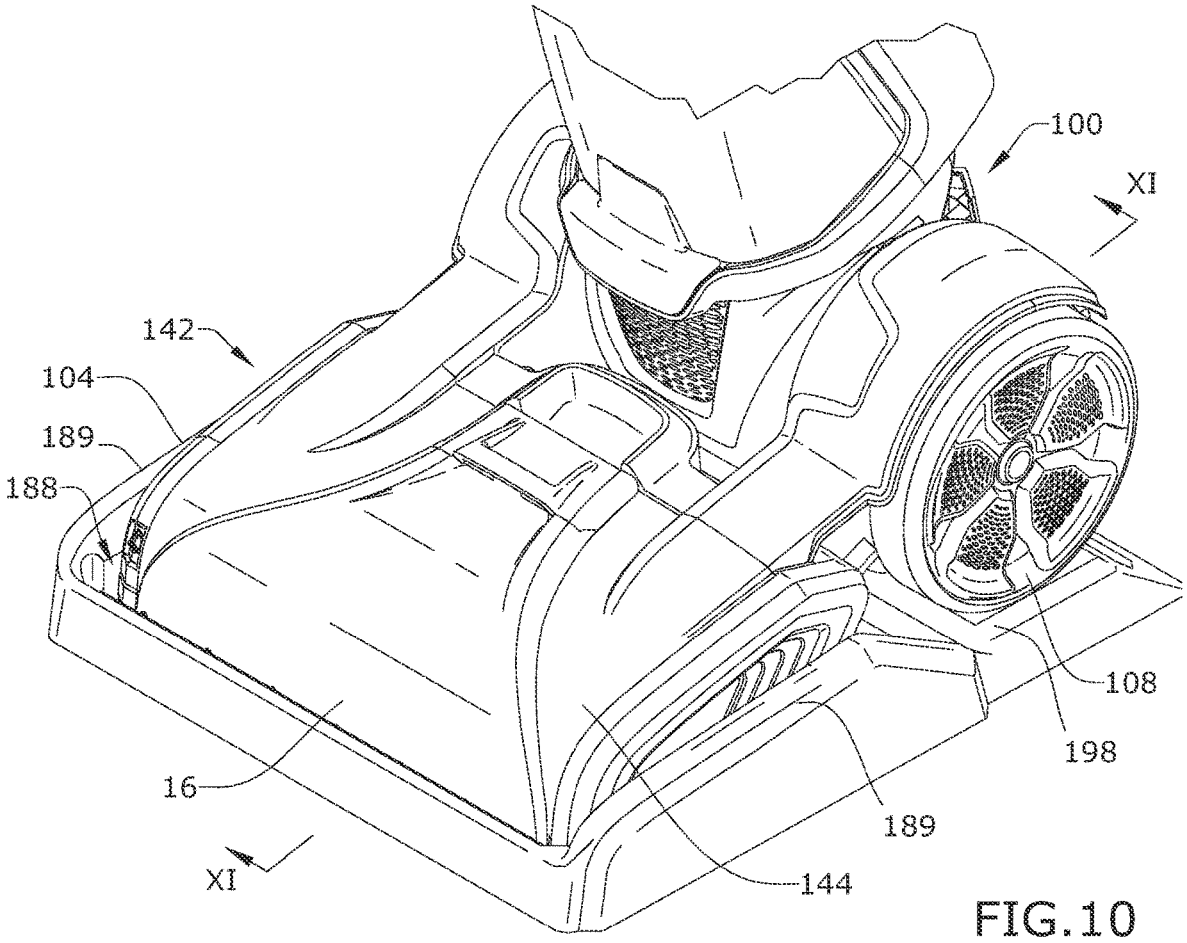
FIG. 10 is a perspective view of an extraction cleaner docked with another cleaning tray according to various aspects described herein.
Figure 11:
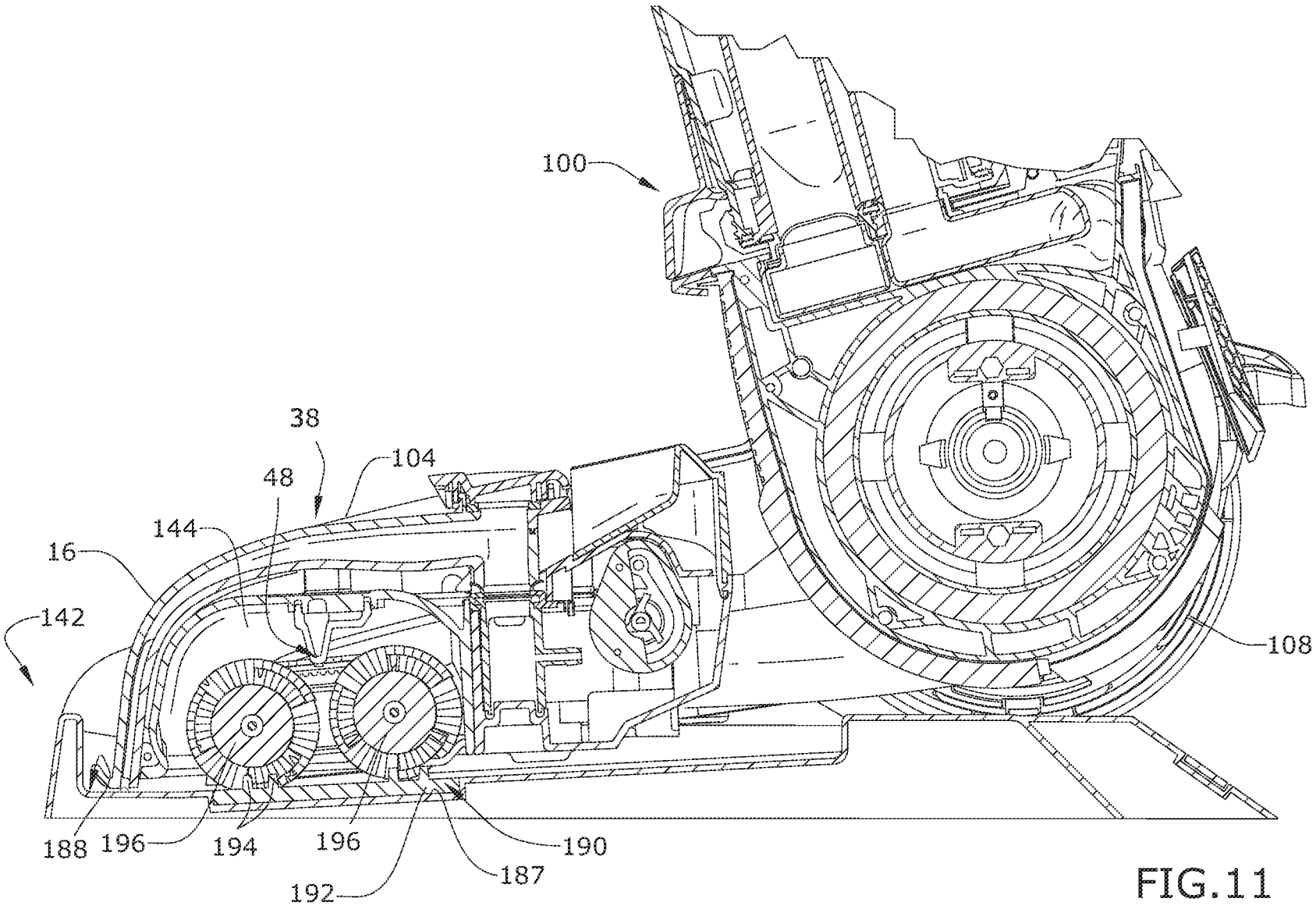
FIG. 11 is a cross-sectional view taken through line XI-XI of FIG. 10.
Figure 12:
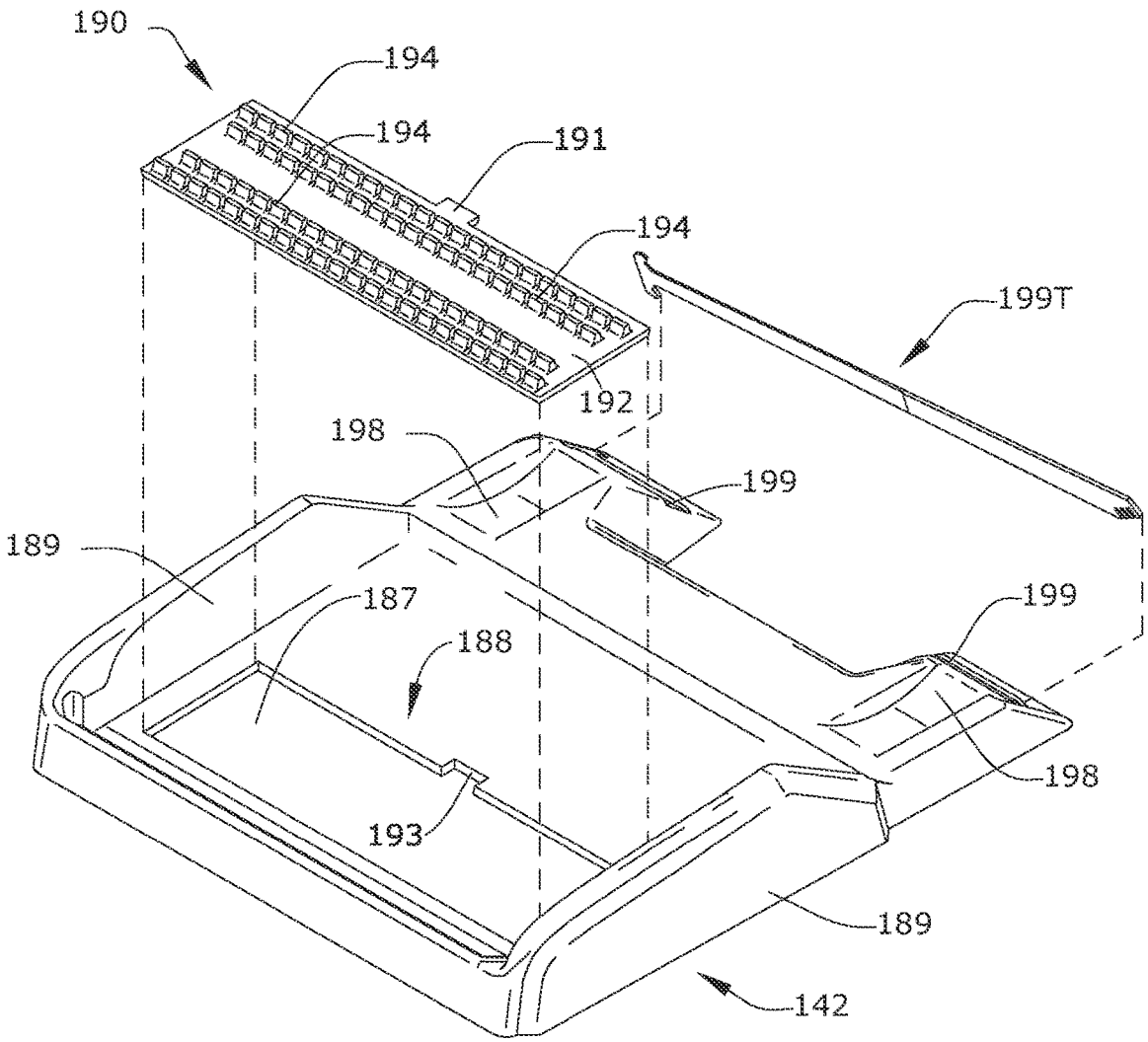
FIG. 12 is an exploded view of the cleaning tray of FIG. 10.

In an alternate aspect of the present disclosure shown in FIGS. 10-12, the tray 142 can be configured as a cleaning tray that physically supports an entire extraction cleaner. The cleaning tray is shown in use with an extraction cleaner as disclosed in U.S. Patent Application Publication No. 2017/0071434, published Mar. 16, 2017, which is incorporated herein by reference in its entirety, but can alternatively be used with the extraction cleaner of FIG. 1 or 2, or other extraction cleaners.

More specifically, a base of the extraction cleaner 100 can be seated in the tray 142. As illustrated in FIG. 10, the body forming the tray 142 can have a recessed portion 188 configured to at least partially surround at least one of the suction nozzle 16 or agitator 26. In addition, the recessed portion 188 can sealingly receive the suction nozzle 16 and agitator 26, such as by sealingly receiving the brush chamber 144. The tray 142 can also include guide walls 189 extending upwardly and configured to align the base assembly 104 of the extraction cleaner 100 within the tray 142. A rear portion of the tray 142 can comprise wheel wells 198 for receiving the rear wheels 108 of the extraction cleaner 100.

Turning to FIG. 11, a side sectional view along line XI-XI is illustrated wherein aspects of the cleaning tray 142 can be seen in further detail. The recessed portion 188 can fluidly isolate, or seal, the suction nozzle 16 and at least one agitator 26, illustrated as brushrolls 196 within the brush chamber 144.

The recessed portion 188 can include a receiver 187 inset within a portion of the recessed portion 188. The receiver 187 can further be configured to receive a brush cleaning insert 190. The brush cleaning insert 190 can include any suitable form, including a rectangular base plate 192 having a plurality of projections 194 such as teeth, nubs or tines extending from the base plate 192 and configured to contact the agitator. In the illustrated example the projections 194 can engage the bristles of brushrolls 196 in the brush chamber 144. In addition, while several rows of the same type of projection 194 are illustrated it will be understood that any of combination or placement of projections 194 can be utilized on the brush cleaning insert 190.

In operation, the extraction cleaner 100 can be docked within the cleaning tray 142. The docking can include aligning at least one of the suction nozzle 16 or brush chamber 144 over the recessed portion 188 within the guide walls 189. The docking can also include aligning the wheels 108 within the wheel wells 198. Once docked, cleaning fluid from the supply container 34 (FIG. 1) can be distributed to the recessed portion 188 via the fluid distributor 38, such as by spraying the cleaning fluid through at least one distributor outlet 48. The suction nozzle 16 can be operated to suction the cleaning fluid from the recessed portion 188 to the recovery container 20 (FIG. 1), thereby cleaning the suction nozzle 16. In addition, the brushrolls 196 can rotate during either or both of the distributing/spraying phase or the suctioning phase. The projections 194 can scrape hair and other debris off the brushrolls 196 as the brushrolls 196 rotate during a cleaning cycle.

Referring now to FIG. 12, it is further contemplated that the insert 190 can be removable from the tray 142 for ease of cleaning and replacement. The base plate 192 can include a protrusion 191 extending from a periphery of the base plate 192. The tray 142 can include a corresponding notch 193 configured to receive the protrusion 191. In FIG. 12, the receiver 187 includes the notch 193 configured to receive the protrusion 191. The coupled protrusion 191 and notch 193 can at least partially hold the insert 190 in place within the tray 142 when assembled. In this manner the insert 190 can be selectively received within at least a portion of the recessed portion 188, defining the receiver 187, and configured to engage the agitator, such as the brushrolls 196 (FIG. 11). In another non-limiting example, the base plate 192 can be configured to snap fit into the at least a portion of the recessed portion 188, defining the receiver 187.

The projections 194 are schematically illustrated as essentially rectangular nubs, and it should be understood that any desired geometric profile can be utilized for the projections 194, including flexible bristles, teeth, pointed/triangular projections, or the like, or combinations thereof. In addition, a rear wall of the tray 142 can optionally comprise a tool recess 199 for mounting additional cleaning tools or accessories. One such example is a nozzle cleanout tool 199T, more fully disclosed in U.S. Patent Application Publication No. 2016/0270620, published Sep. 22, 2016, which is incorporated herein by reference in its entirety.

The tray 142 shown in FIGS. 10-12 is not configured to utilize the accessory hose 116 to deliver cleaning fluid as in the previous aspects of the disclosure, and the tray 142 does not include a fluid delivery manifold or spray nozzles. Instead, the tray 142 of the present aspect of the disclosure encloses the brush chamber 144 and suction nozzle 16 forming a sealed cleaning pathway 146 to the downstream recovery container 20 and fluid is dispensed from a distributor 38 within the brush chamber 144 to wash out the brush chamber 144, suction nozzle 16, and airflow pathway 126 between the suction nozzle 16 and recovery container 20.

Figure 13:
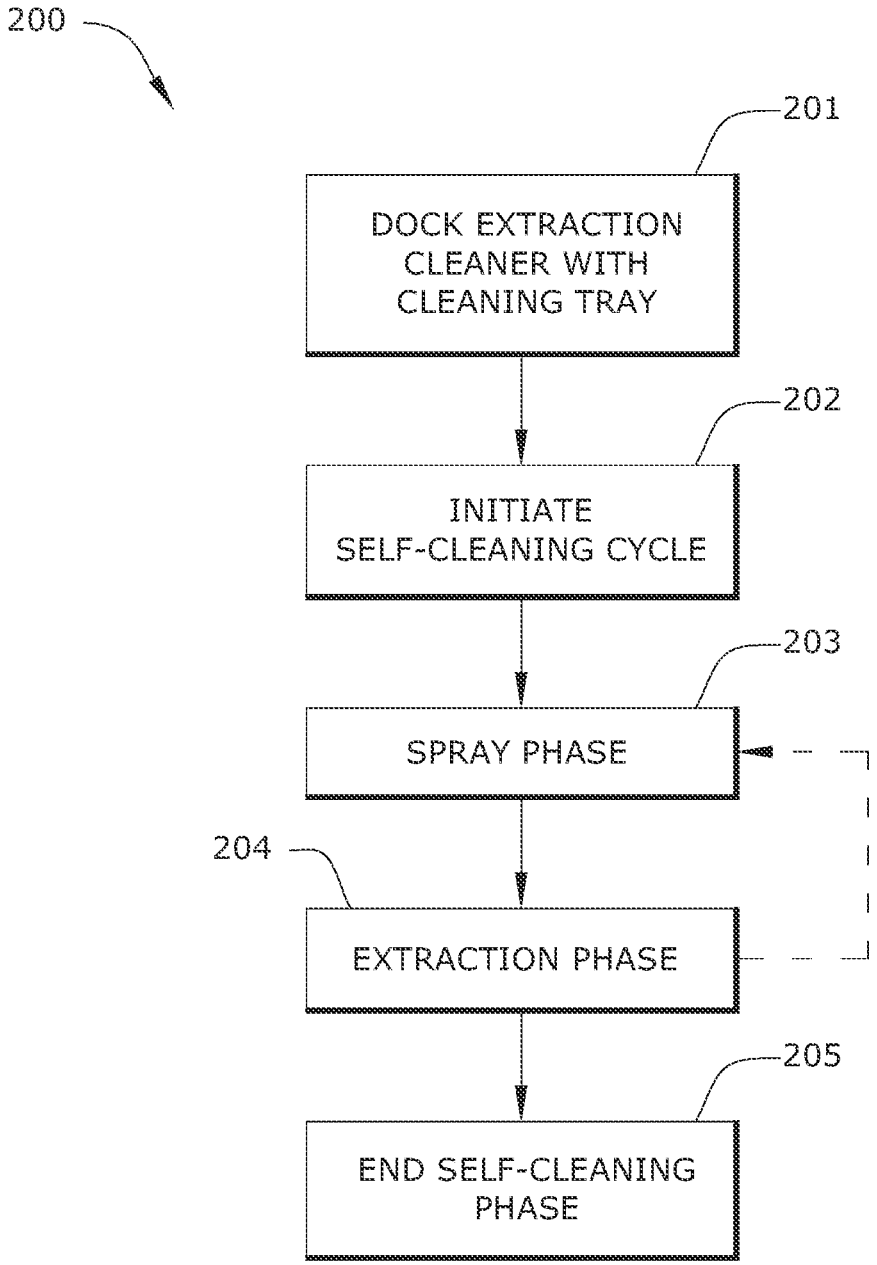
FIG. 13 is a flow chart depicting a self-cleaning method for an upright extraction cleaner using a cleaning tray.

FIG. 13 depicts one aspect of the disclosure of a self-cleaning method 200 for an upright extraction cleaner 100 using the cleaning tray 142. In use, a user at 201 docks the extraction cleaner 100 with the cleaning tray 142. The docking may include parking the base housing 106 of the extraction cleaner 100 on the cleaning tray 142 and inserting the accessory hose 116 into the hose receiver 148. The cleaning tray 142 creates a sealed cleaning pathway between the brush chamber 144 and the suction nozzle 16. The user can then initiate at 202 a self-cleaning cycle of the extraction cleaner 100. The self-cleaning cycle can be manual, with the user initiating the cycle by manually energizing the extraction cleaner 100 and depressing a trigger 140 on the hand grip 114 to distribute cleaning fluid. Alternatively, the self-cleaning cycle can be automated so that the cleaning cycle is controlled by a microcontroller on the extraction cleaner 100. In this case a user-engageable button or switch may be pressed by a user to initiate the automated self-cleaning cycle.

The self-cleaning cycle may begin at 203 with at least one spraying phase in which cleaning solution from the supply container 34 is delivered to the specially-aimed spray nozzles 152 on the cleaning tray 142 that spray the brush chamber 144. Because the hose receiver 148 depresses the trigger 140 on the wand 122 of the accessory hose 116, the pressurized fluid flow through the conduits 154 is sprayed through the spray nozzles 152 to wash off debris and hair from inside the brush chamber 144, including the brushrolls 196. The self-cleaning cycle may use the same cleaning fluid normally used by the extraction cleaner 100 for surface cleaning, or may use a different detergent focused on cleaning the fluid recovery system 14 of the extraction cleaner 100.

The self-cleaning cycle may also include at least one extraction phase at 204 in which the suction source 18 is actuated to suction up the cleaning fluid via the suction nozzle 16. During the extraction phase, the cleaning fluid and debris from the collection reservoir 164 in the tray 142 is sucked through the suction nozzle 16 and the downstream fluid recovery path. The flushing action also cleans the entire fluid recovery path of the extraction cleaner 100, including the suction nozzle 16 and downstream conduits.

The extraction phase of the cleaning cycle can occur simultaneously with the spraying phase or after the spraying phase is complete. In yet another alternative, the extraction phase can initiate after a timed delay from the initiation of the spraying phase. The self-cleaning cycle can optionally repeat the spraying and extraction phases one or more times. For example, the self-cleaning cycle can be configured to repeat the spraying and extraction phases three times before the end of the cycle. The end of the self-cleaning cycle at 205 may be time-dependent, or may continue until the recovery container 20 is full or the supply container 34 is empty. During the spraying phase and/or the extraction phase, the brushrolls 196 can rotate to propel fluid within the brush chamber 144 and provide agitation that enhances the cleaning effect.

Figure 14:
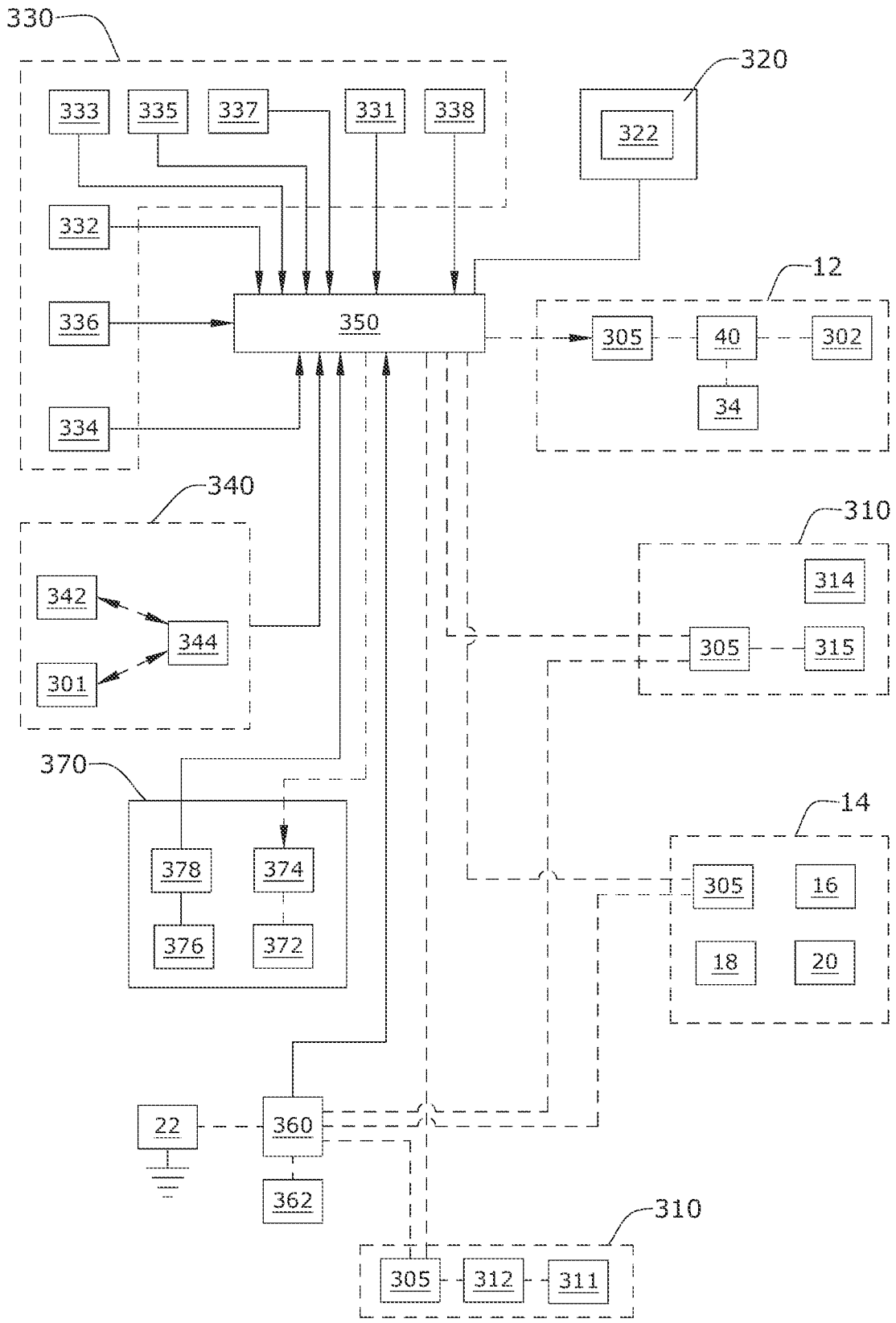
FIG. 14 is a schematic view of another extraction surface cleaning apparatus in the form of a deep cleaning robot according to various aspects described herein.

The self-cleaning system and method is described above with reference to an upright extraction cleaner, but are also generally applicable to other types of extraction cleaners. For example, the self-cleaning system and method can be applied to an autonomous a deep cleaning robot. FIG. 14 is a schematic view of one example of such a deep cleaning robot 300.

The deep cleaning robot 300 mounts the components of various functional systems of the extraction cleaner 10 in an autonomously moveable unit or housing, including components of a fluid delivery system 12 for storing cleaning fluid and delivering the cleaning fluid to the surface to be cleaned, a fluid recovery system 14 for removing the cleaning fluid and debris from the surface to be cleaned and storing the recovered cleaning fluid and debris, a drive system 310 for autonomously moving the robot over the surface to be cleaned, and a navigation/mapping system 320 for guiding the movement of the robot 300 over the surface to be cleaned, generating and storing maps of the surface to be cleaned, and recording status or other environmental variable information. The robot 300 includes a main housing adapted to selectively mount components of the systems to form a unitary movable device.

A controller 350 is operably coupled with the various function systems of robot 300 for controlling its operation. The controller can be a microcontroller unit (MCU) that contains at least one central processing unit (CPU).

As described above, the fluid delivery system 12 can include a supply container 34 for storing a supply of cleaning fluid and a fluid distributor 38 in fluid communication with the supply container 34 for depositing a cleaning fluid onto the surface. The cleaning fluid can be a liquid such as water or a cleaning solution specifically formulated for carpet or hard surface cleaning. The fluid distributor 38 can be one or more spray nozzle 302 provided on the housing of the robot 300. Alternatively, the fluid distributor 38 can be a manifold having multiple outlets. A pump 40 driven by a pump motor 304 is provided in the fluid pathway between the supply container 34 and the distributor 38 to control the flow of fluid to the distributor 38. Various combinations of optional components can be incorporated into the fluid delivery system as is commonly known in the art, such as a heater for heating the cleaning fluid before it is applied to the surface or one more fluid control and mixing valves.

At least one agitator or brush 311 can be provided for agitating the surface to be cleaned onto which fluid has been dispensed. The brush can be a brushroll mounted for rotation about a substantially horizontal axis, relative to the surface over which the robot 300 moves. A drive assembly including a separate, dedicated brush motor 312 can be provided within the robot 300 to drive the brush 311. Alternatively, the brush 311 can be driven by the vacuum motor 313. Other aspects of the disclosure of agitators are also possible, including one or more stationary or non-moving brushes, or one or more brushes that rotate about a substantially vertical axis.

The fluid recovery system 14 (FIG. 1) can include an extraction path through the robot 300 having an air inlet and an air outlet, an extraction or suction nozzle 16 (FIG. 15) which is positioned to confront the surface to be cleaned and defines the air inlet, a recovery container 20 for receiving dirt and liquid removed from the surface for later disposal, and a suction source 18 in fluid communication with the suction nozzle and the recovery container for generating a working air stream through the extraction path. The suction source 18 can be a vacuum motor 313 fluidly upstream of the air outlet, and can define a portion of the extraction path. The recovery container 20 can also define a portion of the extraction path, and can comprise an air/liquid separator for separating liquid from the working airstream. Optionally, a pre-motor filter and/or a post-motor filter (not shown) can be provided as well.

While not shown, a squeegee can be provided on the housing 308, adjacent the suction nozzle 16, and is configured to contact the surface as the robot 300 moves across the surface to be cleaned. The squeegee wipes residual liquid from the surface to be cleaned so that it can be drawn into the fluid recovery pathway via the suction nozzle 16, thereby leaving a moisture and streak-free finish on the surface to be cleaned.

The drive system 310 can include drive wheels 314 for driving the robot 300 across a surface to be cleaned. The drive wheels 314 can be operated by a common drive motor 315 or individual drive motors coupled with the drive wheels 314 by a transmission, which may include a gear train assembly or another suitable transmission. The drive system 310 can receive inputs from the controller 350 for driving the robot 300 across a floor, based on inputs from the navigation/mapping system 320. The drive wheels 314 can be driven in a forward or reverse direction in order to move the robot 300 forwardly or rearwardly. Furthermore, the drive wheels 314 can be operated simultaneously or individually in order to turn the robot 300 in a desired direction.

The controller 350 can receive input from the navigation/mapping system 320 for directing the drive system 310 to move the robot 300 over the surface to be cleaned. The navigation/mapping system 320 can include a memory 322 that stores maps for navigation and inputs from various sensors, which is used to guide the movement of the robot 300. For example, wheel encoders 331 can be placed on the drive shafts of the wheel motors 315, and are configured to measure the distance traveled. This measurement can be provided as input to the controller 350.

Motor drivers 305 can be provided for controlling the pump motor 304, brush motor 312, vacuum motor 313, and wheel motors 317 and acts as an interface between the controller 350 and the motors 304, 312, 313, 317. The motor drivers 305 may be an integrated circuit chip (IC). For the wheel motors 317, one motor driver 305 can controller the motors 317 simultaneously.

The motor drivers 305 for the pump motor 304, brush motor 312, vacuum motor 313, and wheel motors 317 can be electrically coupled to a battery management system 360 which includes a rechargeable battery or battery pack 362. In one example, the battery pack 362 can include lithium ion batteries. Charging contacts for the battery pack 362 can be provided on the exterior of the housing 308. A docking station 301 for receiving the robot 300 for charging can be provided with corresponding charging contacts. In one example, the charging contacts provided on the robot 300 may be an electrical connector such as a DC jack.

The controller is further operably coupled with a user interface (UI) for receiving inputs from a user. The user interface 370 can be used to select an operation cycle for the robot 300 or otherwise control the operation of the robot 300. The user interface can have a display 372, such as an LED display, for providing visual notifications to the user. A display driver 374 can be provided for controlling the display 374, and acts as an interface between the controller 350 and the display 372. The display driver 374 may be an integrated circuit chip (IC). The robot 300 can further be provided with a speaker (not shown) for providing audible notifications to the user.

The user interface 370 can further have one or more switches 376 that are actuated by the user to provide input to the controller 350 to control the operation of various components of the robot 300. A switch driver 378 can be provided for controlling the switch 376, and acts as an interface between the controller 350 and the switch 376.

The controller 350 can further be operably coupled with various sensors for receiving input about the environment and can use the sensor input to control the operation of the robot 300. The sensor input can further be stored in the memory 322 and/or used to develop maps for navigation. Some exemplary sensors are illustrated in FIG. 14. It will be understood that not all sensors shown may be provided, additional sensors not shown may be provided, and that the sensors can be provided in any combination.

The robot 300 can include a positioning or localization system 330 having one or more sensors determining the position of the robot 300 relative to objects, including the wheel encoders 331. The localization system can include one or more infrared (IR) obstacle sensors 332 for distance and position sensing. The obstacle sensors 332 are mounted to the housing of the autonomous robot 300, such as at the front of the robot 300 to determine the distance to obstacles in front of the robot 300. Input from the obstacle sensors 332 can be used to slow down and/or adjust the course of the robot 300 when objects are detected.

Bump sensors 333 can also be provided for determining front or side impacts to the robot 300. The bump sensors 333 may be integrated with a bumper on the housing 308 of the robot 300. Output signals from the bump sensors 333 provide inputs to the controller for selecting an obstacle avoidance algorithm.

In addition to the obstacle and bump sensors, the localization system 330 can include additional sensors, including a side wall sensor 334, one or more cliff sensors 335, and/or an accelerometer 336. The side wall sensor 334 can also be in the form of a wall following sensor located near the side of the robot 300, and can also include a side-facing optical position sensor that provides distance feedback and controls the robot 300 so that the robot 300 can follow near a wall without contacting the wall. The cliff sensors 335 can be bottom-facing optical position sensors that provide distance feedback and control the robot 300 so that the robot 300 can avoid excessive drops such as stairwells or ledges. In addition to optical sensors, the side wall sensors 334 and cliff sensors 335 can be mechanical or ultrasonic sensors.

The accelerometer 336 is an integrated inertial sensor located on the controller and can be a nine-axis gyroscope or accelerometer to sense linear, rotational and magnetic field acceleration. The accelerometer 336 can use acceleration input data to calculate and communicate change in velocity and pose to the controller for navigating the robot 300 around the surface to be cleaned.

The robot 300 can further include one or more lift-up sensors 337, which detect when the robot 300 is lifted off the surface to be cleaned, such as when the user picks up the robot 300. This information is provided as an input to the controller 350, which will halt operation of the pump motor 304, brush motor 312, vacuum motor 313, and/or wheel motors 317. The lift-up sensors 337 may also detect when the robot 300 is in contact with the surface to be cleaned, such as when the user places the robot 300 back on the ground; upon such input, the controller 350 may resume operation of the pump motor 304, brush motor 312, vacuum motor 313, and wheel motors 317.

While not shown, the robot 300 can optionally include one or more sensors for detecting the presence of the supply and recovery containers 34, 20. For example, one or more pressure sensors for detecting the weight of the supply container 34 and the recovery container 20 can be provided. This information is provided as an input to the controller 350, which may prevent operation of the robot 300 until the supply and recovery containers 34, 20 are properly installed. The controller 350 may also direct the display 372 to provide a notification to the user that the supply container 34 or recovery container 20 is missing.

The robot 300 can further include one or more floor condition sensors 338 for detecting a condition of the surface to be cleaned. For example, the robot 300 can be provided with an infrared dirt sensor, a stain sensor, an odor sensor, and/or a wet mess sensor. The floor condition sensors 338 provide input to the controller 350, which may direct operation of the robot 300 based on the condition of the surface to be cleaned, such as by selecting or modifying a cleaning cycle.

An artificial barrier system 340 can also be provided for containing the robot 300 within a user-determined boundary. The artificial barrier system 340 can include an artificial barrier generator 342 that comprises a housing with at least one sonic receiver for receiving a sonic signal from the robot 300 and at least one IR transmitter for emitting an encoded IR beam towards a predetermined direction for a predetermined period of time. The artificial barrier generator 342 can be battery-powered by rechargeable or non-rechargeable batteries. In one aspect of the disclosure, the sonic receiver can comprise a microphone configured to sense a predetermined threshold sound level, which corresponds with the sound level emitted by the robot 300 when it is within a predetermined distance away from the artificial barrier generator. Optionally, the artificial barrier generator 342 can further comprise a plurality of IR emitters near the base of the housing configured to emit a plurality of short field IR beams around the base of the artificial barrier generator housing. The artificial barrier generator 342 can be configured to selectively emit one or more IR beams for a predetermined period of time, but only after the microphone senses the threshold sound level, which indicates the robot 300 is nearby. Thus, the artificial barrier generator 342 is able to conserve power by emitting IR beams only when the robot 300 is in the vicinity of the artificial barrier generator.

The robot 300 can have a plurality of IR transceivers 344 around the perimeter of the robot 300 to sense the IR signals emitted from the artificial barrier generator 342 and output corresponding signals to the controller, which can adjust drive wheel control parameters to adjust the position of the robot 300 to avoid the boundaries established by the artificial barrier encoded IR beam and the short field IR beams. This prevents the robot 300 from crossing the artificial boundary and/or colliding with the artificial barrier generator housing. The IR transceivers 344 can also be used to guide the robot 300 toward the docking station 301.

In operation, sound emitted from the robot 300 greater than a predetermined threshold sound level is sensed by the microphone and triggers the artificial barrier generator 342 to emit one or more encoded IR beams as described previously for a predetermined period of time. The IR transceivers 344 on the robot 300 sense the IR beams and output signals to the controller 350, which then manipulates the drive system 310 to adjust the position of the robot 300 to avoid the border established by the artificial barrier system 340 while continuing to perform a cleaning operation on the surface to be cleaned.

Figure 15:
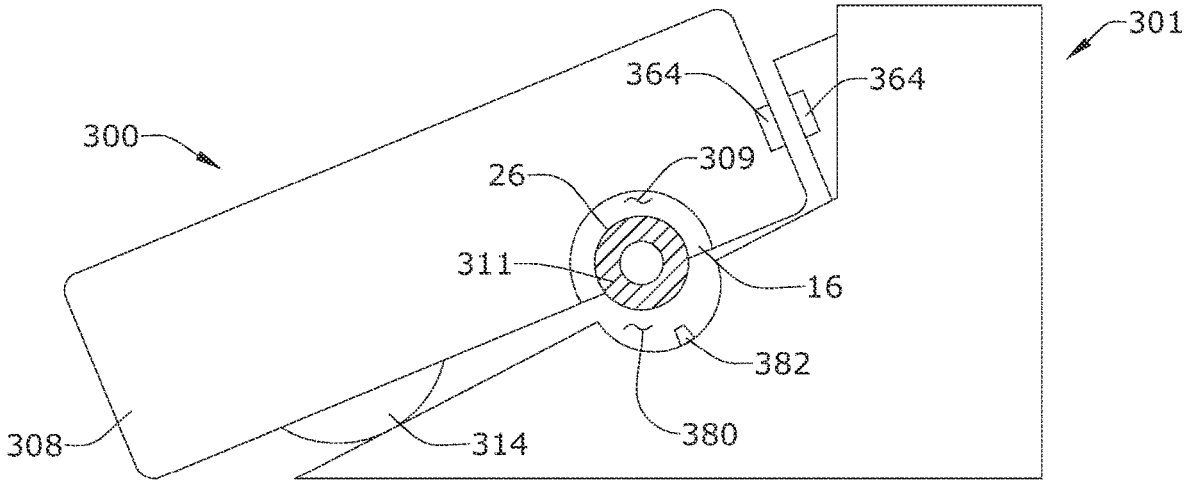
FIG. 15 is a perspective view of the deep cleaning robot of FIG. 14 docked with a self-cleaning docking station according to various aspects described herein.

FIG. 15 shows a deep cleaning robot 300 that includes the systems and components shown in FIG. 14 docked with a self-cleaning docking station 301 according to non-limiting aspects of the disclosure Like upright extraction cleaners, deep cleaning robots can get very dirty, particularly in the brush chamber and extraction pathway, and can be difficult for the user to clean. A self-cleaning system and method using the docking station shown in FIG. 15 is provided for the deep cleaning robot 300, which saves the user considerable time and may lead to more frequent use of the deep cleaning robot 300.

The deep cleaning robot 300 can have an integrated self-cleaning mode or cycle configured to be run when the deep cleaning robot 300 is docked with the docking station as shown in FIG. 15. The docking station is configured to create a sealed cleaning pathway between a brush chamber 309 and suction nozzle 16 when the robot 300 is docked therein. The user can then engage the self-cleaning cycle, which washes out the brush chamber 309 via the sealed cleaning pathway.

The docking station can include a recessed portion in the form of a sump 380 for collecting excess liquid and guiding it towards the suction nozzle 16 for eventual extraction. The sump 380 can be configured to align with the brush chamber 309 of the robot 300, and can include one or more spray nozzles 382 for spraying cleaning fluid into the brush chamber 309. The spray nozzles 382 can be in communication with a source of cleaning fluid stored on the docking station 301, or can be coupled with the fluid delivery system 12 of the robot 300 when docked and be supplied with fluid from the supply container 34.

The docking station 301 can include a ramp 384 which the robot 300 drives up to couple with charging contacts 364 for recharging the battery pack 362 (FIG. 14). The docking station 301 itself can be connected to external power to charge the battery pack 362. The docking station 301 can be configured such that when the robot 300 is docked for charging, it is also in correct alignment with the sump 380 for self-cleaning. The docking station 301 can also be used when storing the robot 300 after use or self-cleaning, and can catch any drips from the robot 300.

Figure 16:
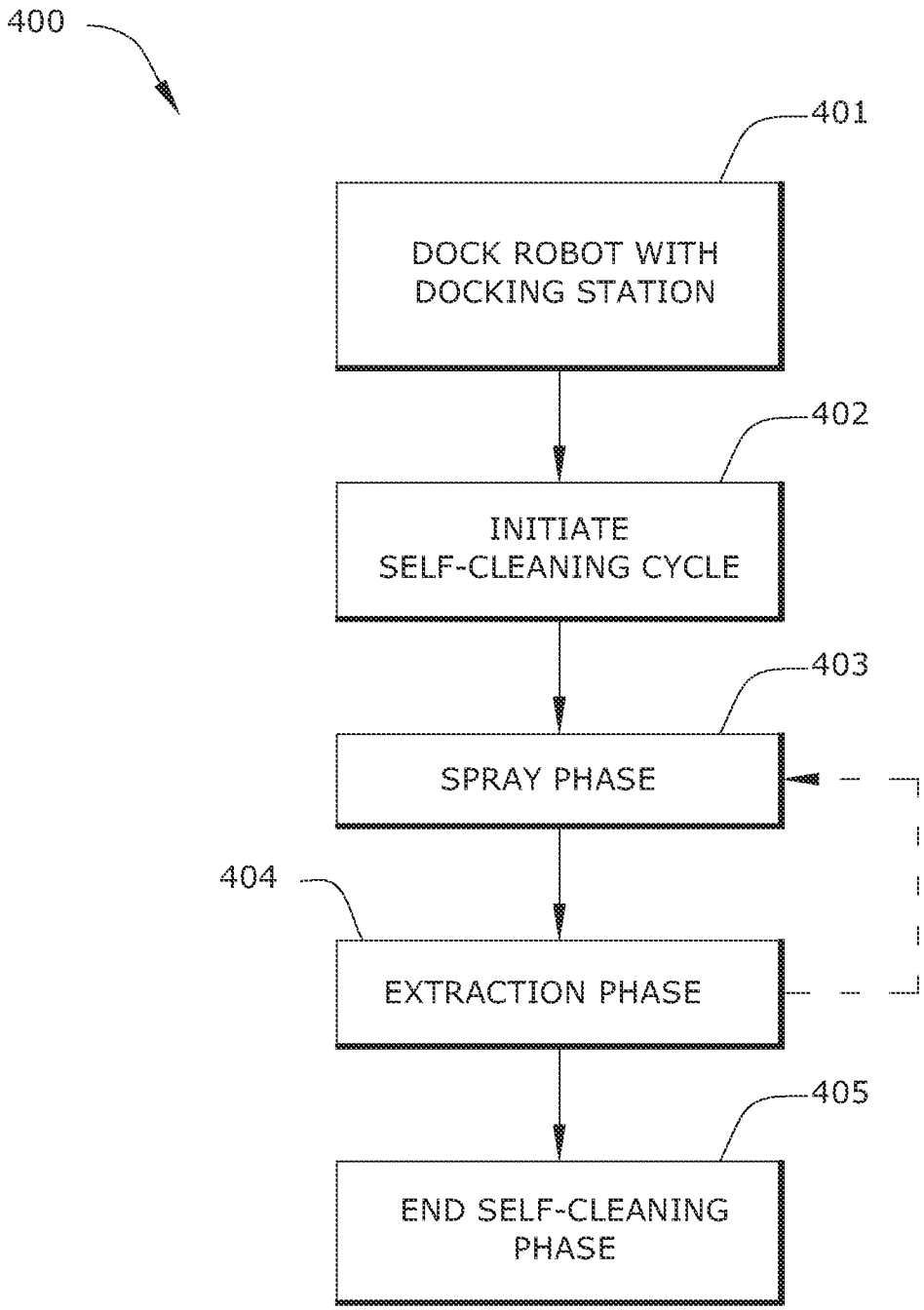
FIG. 16 is a flow chart depicting a self-cleaning method for the deep cleaning robot of FIG. 15 using the docking station of FIG. 15.

FIG. 16 depicts one aspect of the disclosure of a self-cleaning method 400 for a deep cleaning robot 300 using the docking station 301. In use, at 401 the deep cleaning robot 300 docks with the docking station 301. The docking may include autonomously driving the robot 300 to the docking station 301 and up the ramp 384 to create a sealed cleaning pathway between the brush chamber 309 and the suction nozzle 16. Once docked, the drive wheels 314 are stopped. The deep cleaning robot 300 may return to the docking station 301 based on battery charge, the level of cleaning fluid in the supply container 34 reaching a predetermined lower limit, or the level of recovered fluid in the recovery container 20 reaching a predetermined upper limit. When docked, the charging contacts 364 couple and the battery pack 362 may begin being recharged.

Once docked, a self-cleaning cycle or mode of operation can be initiated at 402. Prior to initiation of the self-cleaning cycle, the robot 300 may send a confirmation signal to the docking station 301 indicating that the robot 300 has successfully docked, and it ready to commence self-cleaning. For example, an RF signal can be send from the robot 300 to the docking station 301, and back to the robot 300. Alternatively, a pulsed signal can be sent through the charging pathway between the charging contacts 364. As yet another alternative, an IR signal can be sent to the robot 300 to an IR receiver on the docking station 301.

The self-cleaning cycle can be manually initiated, with the user initiating the cycle by pressing a button on the user interface 370 (FIG. 14). The self-cleaning cycle may be locked-out by the controller 350 (FIG. 14) when the deep cleaning robot 300 is not docked to prevent inadvertent initiation of the self-cleaning cycle.

Alternatively, the self-cleaning cycle can be automated so that the cleaning cycle is controlled by the controller 350 and automatically initiates once the deep cleaning robot 300 is docked in the docking station 301. For example, the self-cleaning cycle can be designed as a default setting configured to be run after each floor cleaning operation by the robot 300, after a predetermined amount of run time, or when the charge level of the battery 362 (FIG. 14) reaches a lower threshold.

It is also noted that the self-cleaning cycle may be initiated before the robot 300 docks with the docking station 301, and that the movement of the robot 300 into the docking relationship shown in FIG. 15 with the docking station 301 may be considered part of the self-cleaning cycle. In this case a user-engageable button or switch may be pressed by a user to initiate the automated self-cleaning cycle and the robot 300 drives to and docks with the docking station 301.

Alternatively, the deep cleaning robot 300 can be provided with a sensor (not shown) for detecting when the fluid recovery system 14 and/or extraction pathway of the robot 300 is in need of cleaning, and input from the sensor can be provided to the controller 350 which implements the self-cleaning cycle.

The self-cleaning cycle may begin with at least one spraying phase at 403 in which cleaning solution is delivered to the at least one spray nozzle 382 in the sump 380 that sprays the brush chamber 309. During the spraying phase, the brush motor 312 (FIG. 14) is active and can spin the brush 311 at a high rate while applying cleaning fluid to the brush 311 to flush the brush chamber 309 and cleaning lines, and wash debris from the brush 311. The self-cleaning cycle may use the same cleaning fluid normally used by the deep cleaning robot 300 for floor cleaning, or may use a different detergent focused on cleaning the fluid recovery system 14 of the robot 300.

The self-cleaning cycle may also include at least one extraction phase at 404 in which the suction source 18 (FIG. 14) is actuated to suction up the cleaning fluid in the sump 380 via the suction nozzle 16. The high-speed rotation of the brush 311 may also help extract cleaning fluid from the brush 311. During the extraction phase, the cleaning fluid and debris from the sump 380 is sucked through the suction nozzle 16 and the downstream extraction path. The flushing action also cleans the entire extraction path of the robot 300, including the suction nozzle 16 and downstream conduits.

The extraction phase of the cleaning cycle can occur simultaneously with the spraying phase or after the spraying phase is complete. In yet another alternative, the extraction phase can initiate after a timed delay from the initiation of the spraying phase. The self-cleaning cycle can optionally repeat the spraying and extraction phases one or more times. For example, the self-cleaning cycle can be configured to repeat the spraying and extraction phases three times before the end of the cycle. The end of the self-cleaning cycle at 405 may be time-dependent, or may continue until the recovery container 20 is full or the supply container 34 is empty. After the end of the self-cleaning cycle, the docked deep cleaning robot 300 can power off or continue to recharge the battery.

For a timed self-cleaning cycle, the pump 40, brush motor 312, and suction source 18 are energized and de-energized for predetermined periods of time. Optionally, the pump 40 or brush motor 312 can pulse on/off intermittently so that any debris is flushed off of the brush 311 and extracted into the recovery container 20. Optionally, the brush 311 can be rotated at slower or faster speeds to facilitate more effective wetting, shedding of debris, and/or spin drying. Near the end of the cycle, the pump 40 can de-energize to end the spraying phase while the brush motor 312 and suction source 18 can remain energized to continue the extraction phase. This is to ensure that any liquid remaining in the sump 380, on the brush 311, or in the fluid recovery path is completely extracted into the recovery container 20.

Figure 17:
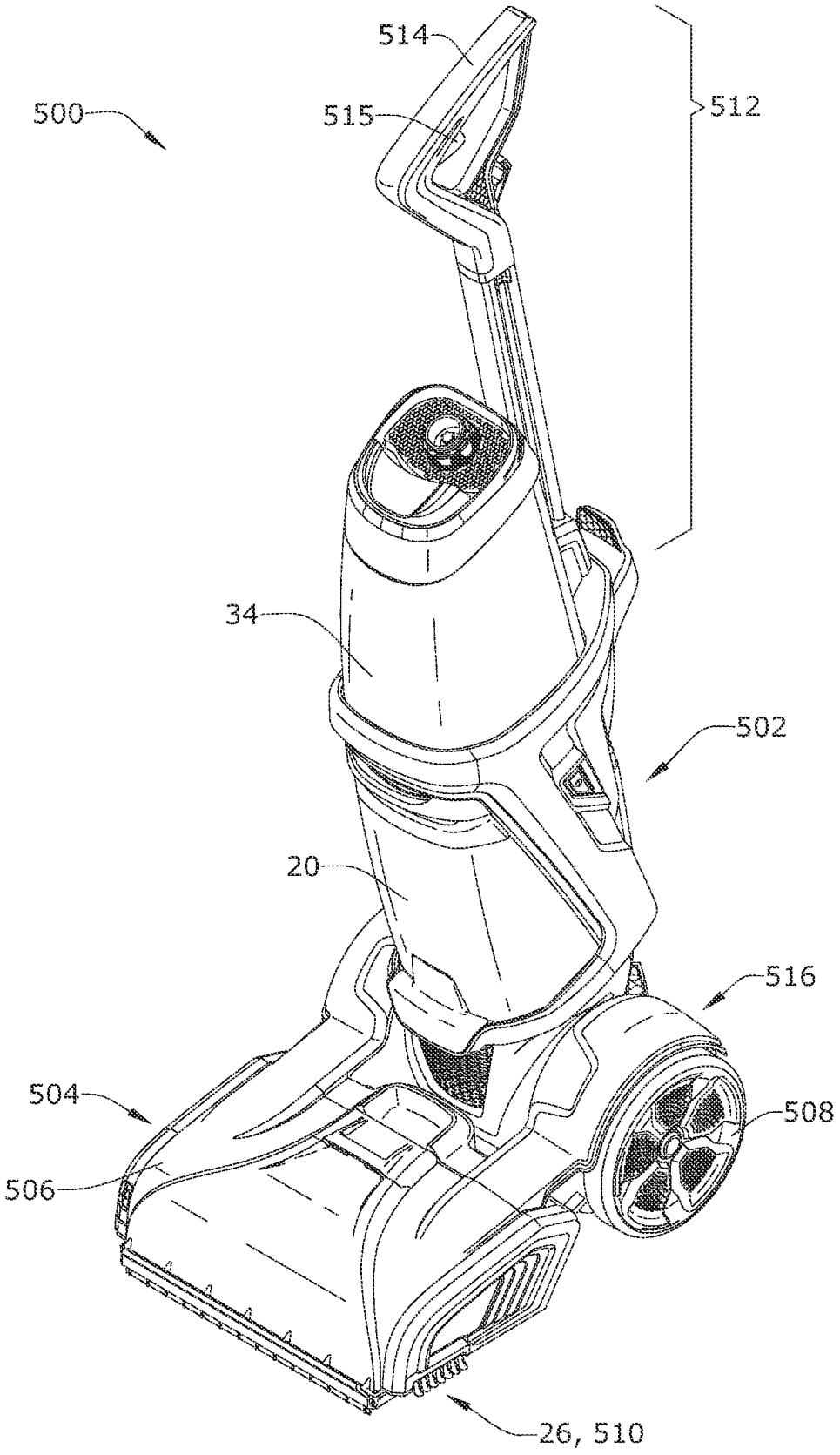
FIG. 17 is a perspective view of another extraction surface cleaning apparatus in the form of an upright extraction cleaner according to various aspects described herein.

FIG. 17 is a perspective view illustrating another extraction cleaner 500 that is similar to the extraction cleaner 100. As illustrated herein, the extraction cleaner 500 is an upright extraction cleaner having a housing that includes an upright assembly 502 that is pivotally connected to a base assembly 504 for directing the base assembly 504 across the surface to be cleaned. The extraction cleaner 500 can comprise the various systems and components schematically described for FIG. 1, including the fluid delivery system 12 for storing and delivering a cleaning fluid to the surface to be cleaned and the recovery system 14 for extracting and storing the dispensed cleaning fluid, dirt and debris from the surface to be cleaned. The various systems and components schematically described for FIG. 1, including the fluid delivery system 12 and fluid recovery system 14 can be supported by either or both the base assembly 504 and the upright assembly 502.

For purposes of description related to the figures, the terms "upper," "lower," "right," "left," "rear," "front," "vertical," "horizontal," "inner," "outer," and derivatives thereof shall relate to the extraction cleaner 500 as oriented in FIG. 17 from the perspective of a user behind the extraction cleaner 500, which defines the rear of the extraction cleaner 500. However, it is to be understood that the disclosure may assume various alternative orientations, except where expressly specified to the contrary.

The upright assembly includes a main support section or frame supporting components of the fluid delivery system 12 and the recovery system 14, including, but not limited to, the recovery container 20 and the supply container 34. Additional details of the recovery container 20 for the extraction cleaner 500, which can include an air/liquid separator assembly (not shown) are disclosed in U.S. Patent Application Publication No. 2017/0071434, published Mar. 16, 2017, which is incorporated herein by reference in its entirety. The upright assembly 502 also has an elongated handle 512 extending upwardly from the frame that is provided with a hand grip 514 at one end that can be used for maneuvering the extraction cleaner 500 over a surface to be cleaned. Optionally, the hand grip 514 can include an actuator in the form of a trigger 515 for selective operation of one or more components of the extraction cleaner 500. The frame of the upright assembly can include container receivers for respectively receiving the recovery and supply containers 20, 34 for support on the upright assembly; additional details of the container receivers are disclosed in U.S. Patent Application Publication No. 2017/0071434, incorporated above. A motor housing 516 is formed at a lower end of the frame and contains the motor/fan assembly 19 (FIG. 1) positioned therein in fluid communication with the recovery container. Additional details of the motor housing 516 are disclosed in U.S. Patent Application Publication No. 2017/0071434, incorporated above.

The base assembly 504 includes a base housing 506 supporting components of the fluid delivery system 12 and the recovery system 14, including, but not limited to, the suction nozzle 16, the agitator 26, the pump 40, and at least one fluid distributor 38. Wheels 508 at least partially support the base housing 506 for movement over the surface to be cleaned. An additional agitator 26 in the form of stationary edge brushes 510 may also be provided on the base housing 506.

Figure 18:
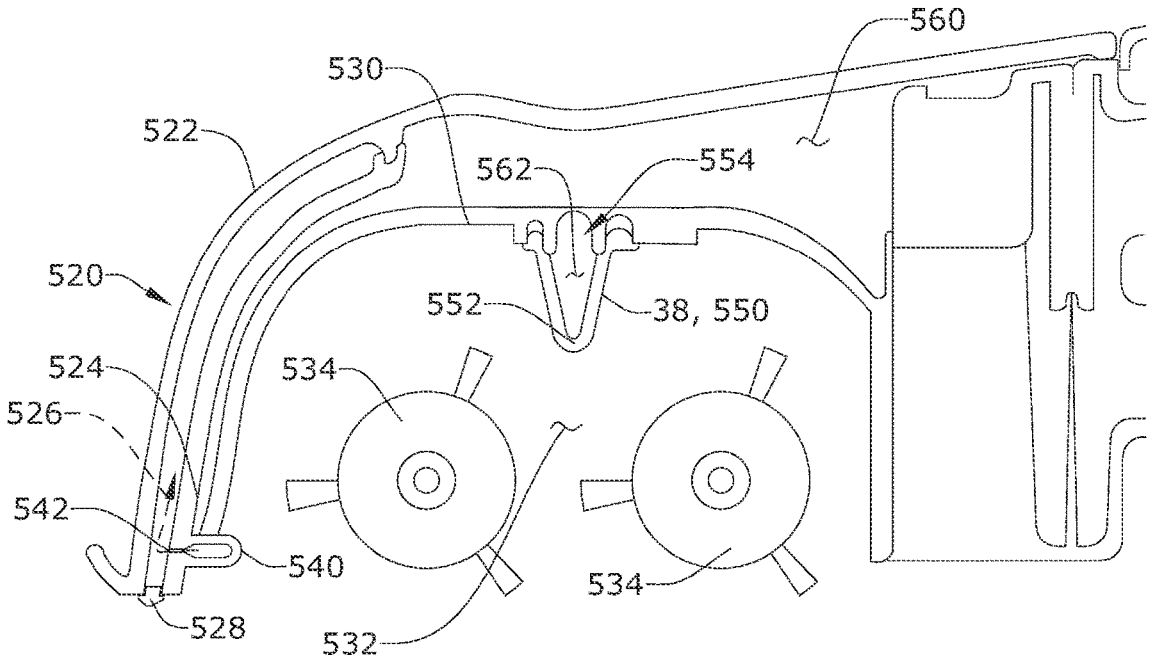
FIG. 18 is a cross-sectional view through a centerline of a base assembly of the extraction cleaner of FIG. 17.

FIG. 18 is a sectional view of a base assembly of the extraction cleaner 500 of FIG. 17. The suction nozzle of the extraction cleaner 500 can include a nozzle assembly 520 having a front wall 522 and a rear wall 524 defining a narrow suction pathway 526 therebetween with an opening forming a suction nozzle inlet 528 adjacent the surface to be cleaned. The suction pathway 526 is in fluid communication with a recovery airflow conduit 518 leading to the recovery container 20. The suction nozzle assembly 520 can be configured to be removable as a unit from the base assembly 504, with the front and rear walls 522, 524 fixedly attached together in a non-separable configuration. For example, the front and rear walls 522, 524 can be welded together.

An agitator housing 530 is provided beneath the suction nozzle 16 and defines an agitator or brush chamber 532 for the agitator 26. The agitator 26 of the illustrated aspect of the disclosure includes dual horizontally-rotating brushrolls 534 which are operatively coupled with the motor/fan assembly 19 (FIG. 1) via a transmission 536, which can include one or more belts, gears, shafts, pulleys, or combinations thereof. Details of the agitator drive can be found in U.S. Patent Application Publication No. 2017/0071434, incorporated above.

Figure 19:
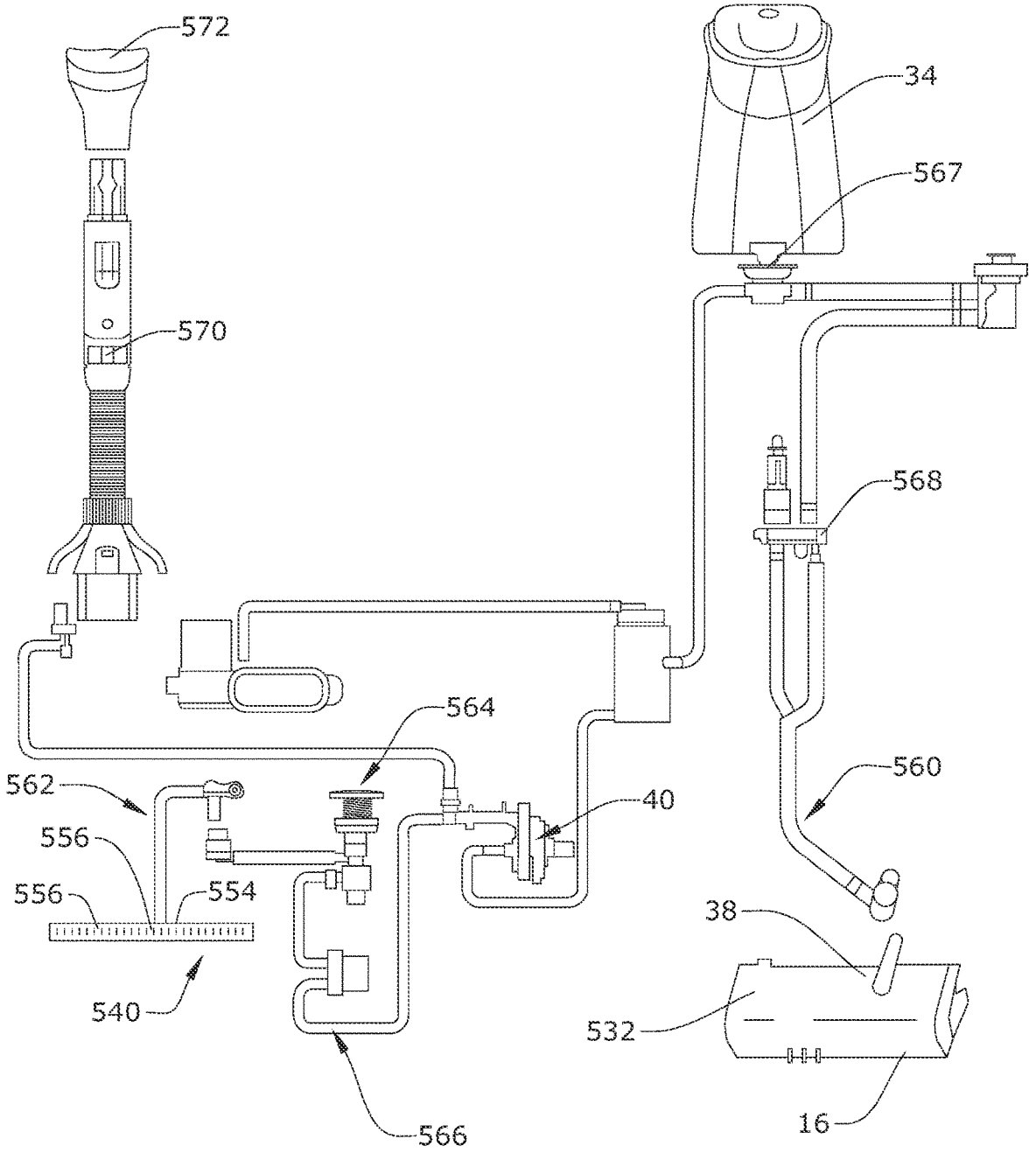
FIG. 19 is a schematic view of a fluid delivery system of the extraction cleaner of FIG. 17.

FIG. 19 is a schematic view of the fluid delivery system 12 of the extraction cleaner 500 of FIG. 17-18. The fluid delivery system 12 of the illustrated aspect of the disclosure includes a fluid distributor 38 in fluid communication with the supply container 34 for depositing a cleaning fluid onto the surface and a nozzle flushing manifold 540 in fluid communication with the supply container 34 for cleaning the suction nozzle 16, as well as the other components forming the working air path between the suction nozzle 16 and the recovery container 20. The fluid distributor 38 may be mounted to the brush chamber 532 as illustrated. The distributor 38 can be removable with the brush chamber 532.

The fluid distributor 38 includes at least one sprayer 550 positioned to dispense fluid onto the surface to be cleaned. The at least one sprayer 550 can dispense fluid directly onto the surface to be cleaned, such as by having an outlet of the sprayer 550 positioned in opposition to the surface, or indirectly onto the surface to be cleaned, such as by having an outlet of the sprayer 550 positioned to dispense into the brushrolls 534 (see FIG. 18).

The at least one sprayer 550 of the fluid distributor 38 can be an elongated spray bar 554 or manifold provided with a plurality of distributor outlets 556 along its length. The spray bar 554 is trough-like, with an open top that receives fluid, which then flows along the length of the spray bar 554 and out through the distributor outlets 556. The distributor outlets 556 can be positioned to dispense cleaning fluid between the brushrolls 534, shown in FIG. 18. The spray bar 554 can be mounted on the agitator housing 530, and a portion of the agitator housing 530 may form a portion of a conduit 560 that supplies cleaning fluid from the fluid container to the spray bar. Here the agitator housing 530 may form an upper enclosure for a fluid pathway 562 through the spray bar 554 leading to the distributor outlets 556. The conduit 560 can extend from the base assembly 504 to the supply container 34 in the upright assembly 502, and may be made up of one or more flexible and/or rigid sections.

The nozzle flushing manifold 540 is mounted on the nozzle assembly 520, such as on the rear wall 524 of the nozzle assembly 520. The flushing manifold 540 includes one or a plurality of outlets 542 formed in the lower rear wall 524 to form a flow path from the manifold 540 into the suction pathway 526 of the suction nozzle 16. In one aspect of the disclosure, a plurality of outlets 542 are provided along the width of the suction nozzle 16. The outlets 542 spray directly into the suction pathway 526, and do not spray towards the surface to be cleaned.

A flow control mechanism or control valve 564 upstream from the manifold 540 can be fluidly connected to a pressurized supply line 566. The supply line 566 may be made up of one or more flexible and/or rigid sections, and may include a pump.

To flush the suction nozzle 16 and downstream working air path, a user selectively opens the control valve 564 and cleaning solution flows into the manifold 540 and is forced through the outlets 552, into the suction pathway of the suction nozzle 16. The cleaning solution rinses debris and flushes away odor from the working air path. The cleaning solution flows through the working air path and is collected in the recovery container 20.

The extraction cleaner 500 can also be provided with above-the-floor cleaning features. An accessory hose 570 can be selectively fluidly coupled to the motor/fan assembly 19 for above-the-floor cleaning using an above-the floor cleaning tool 572 with its own suction inlet. A diverter assembly can be selectively switched between on-the-floor and above-the floor cleaning by diverting fluid communication between either the suction nozzle 16 or the accessory hose 570 with the motor/fan assembly 19. The accessory hose 570 can also communicate with the fluid delivery system 12 to selectively deliver cleaning fluid.

The outlet of the supply container 34 is coupled to a receiver valve assembly 567 with two outlets to feed the pump and the fluid distributor, which is gravity-fed. The conduit 560 feeding the fluid distributor 38 includes a flow controller assembly 568, which in this aspect of the disclosure includes an adjustable valve that permits varied flow rate operation. The conduit extending from the outlet of the pump 40 branches into two separate conduits, one feeding the nozzle flushing manifold 540 and one feeding the accessory hose 570. When the accessory hose 570 is not installed and the control valve 564 is not open, the pump 40, which in this aspect of the disclosure is a centrifugal pump, operates in a "dead-head" condition, meaning the pump 40 continues to operate, but fluid is recirculated within the pump 40. Various combinations of optional components can be incorporated into the fluid delivery system 12 such as a heater, additional supply containers, and/or additional fluid control and mixing valves.

The extraction cleaner 500 can be provided with separate actuators for the fluid distributor and the nozzle flushing manifold, such that the fluid distribution and nozzle cleaning features can be individually activated. In the illustrated aspect of the disclosure, the actuator for the primary fluid distributor 38 comprises the trigger 515 (FIG. 17) provided within the hand grip and operably coupled with a flow controller assembly 568 (FIG. 19) of the fluid delivery system 12 to dispense fluid from the fluid distributor 38. The trigger 515 can be positioned inside of the hand grip 514 for easy manipulation by a trigger finger of the user's hand that is gripping the hand grip 514.

Figure 20:
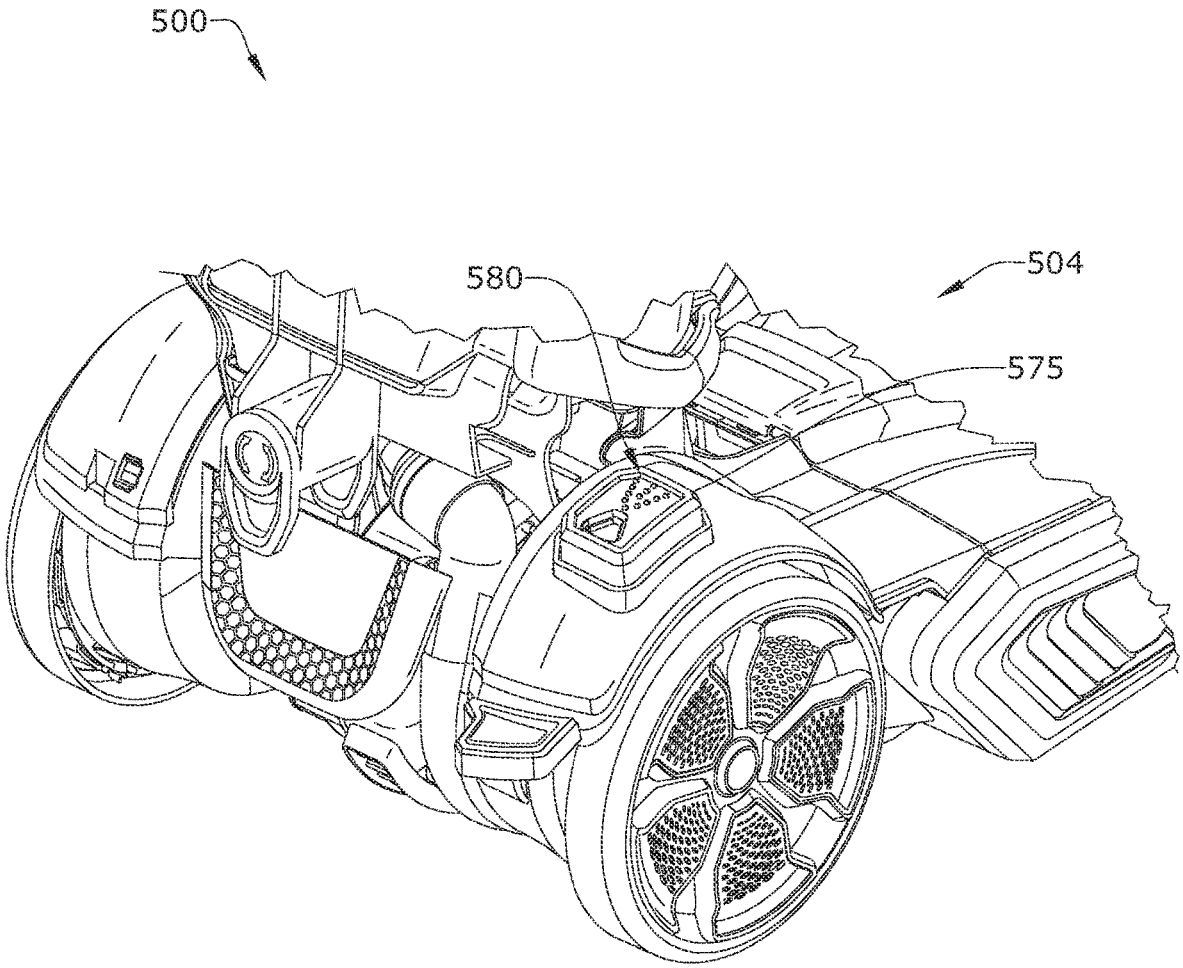
FIG. 20 is a rear perspective view of the base assembly of the extraction cleaner of FIG. 17 to show a control pedal for a nozzle cleaning feature.

FIG. 20 is a rear perspective view of the base assembly 504 of the extraction cleaner 500 of FIG. 17 to show a control pedal 575 for a push-push flow control mechanism 580 of the nozzle flushing manifold 540 (FIG. 18). The control pedal 575 can be provided on the base assembly 504 and is operably coupled with the push-push flow control mechanism 580 to selectively flush the suction nozzle 16. The control pedal 575 is configured and adapted to be actuated by the foot of a user of the extraction cleaner 500. The pedal 575 is provided on a rear, upper portion of the base assembly 504, such that it can be easily pressed by the foot of the user operating the extraction cleaner 500 from the normal operational position behind the extraction cleaner 500.

Figure 21:
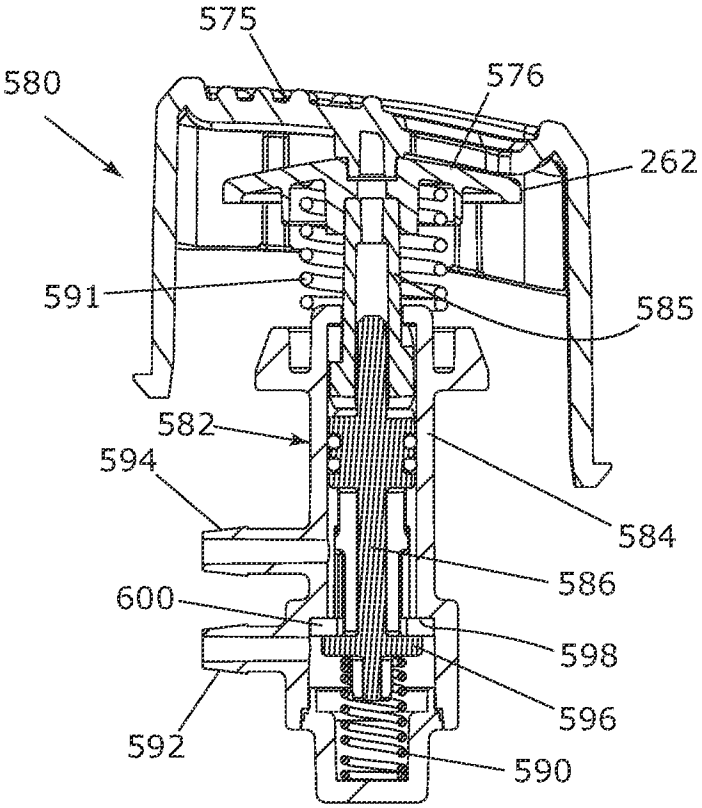
FIG. 21 is a sectional view through a push-push flow control valve operably coupled with the control pedal from FIG. 20, where the valve is shown in a closed position.

FIG. 21 is a sectional view through a push-push flow control mechanism for the nozzle flushing feature. The control pedal 575 can comprise a push-push flow control mechanism 580 and can include a mechanically-actuated valve assembly 582. The push-push flow control mechanism 580 has a "push on/push off" configuration, where pushing the control pedal 575 once starts fluid flow and subsequently pushing the control pedal 575 again stops fluid flow. A status indicator 576 can be provided on the control pedal 575 to indicate to the user whether the suction nozzle 16 is being flushed.

The valve assembly 582 includes a valve body 584 that remains fixed in its location, a valve piston 586 that moves up and down a central axis 588 of the valve assembly 542, and a plunger 585 that moves up and down and rotates relative to the central axis of the valve assembly. The control pedal 575 acts as an interface between the operator and the valve assembly. A first spring 590 can bias the valve piston upwardly away from a bottom or end wall of the valve body, and a second spring 591 biases the control pedal 575 upwardly away from the valve housing.

Figure 22:
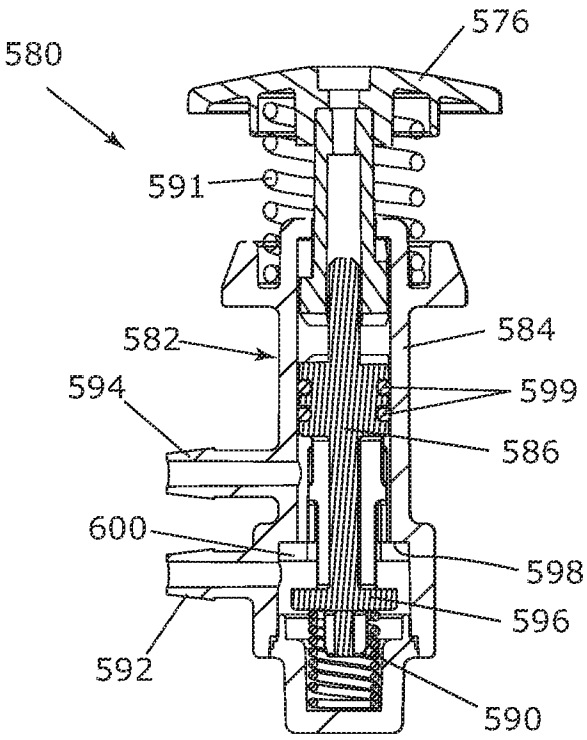
FIG. 22 is a sectional view similar to FIG. 21, where the valve is shown in an open position.

The valve body 584 includes an inlet 592 in fluid communication with the pump 40 (FIG. 19) and an outlet 594 in fluid communication with the nozzle flushing manifold 540. The outlet 594 is blocked by the valve piston 586 when the valve assembly 582 is closed or the control pedal 575 is in the "off" position, as shown in FIG. 21. The valve piston 586 moves to unblock the outlet 594 when the valve assembly 582 is open or the control pedal 575 is in the "on" position, as shown in FIG. 22. More particularly, the valve piston 586 includes a flange 596 and the valve body 584 includes a valve seat 598 and a valve seal 600. The flange 596 contacts the face of the seal 600 when the valve assembly 582 is closed, as shown in FIG. 21. When open, the flange 596 moves away from the valve seal 600, to a position at least partially below the inlet 592, such that the fluid pathway through the valve body 584 is open between the inlet 592 and outlet 594. The valve seal 600 can be a resilient washer mounted on the valve seat 598. O-rings 599 can be provided on the valve piston 586 to ensure that fluid does not leak past the valve piston 586 through an upper portion of the valve body 584.

Figure 23:
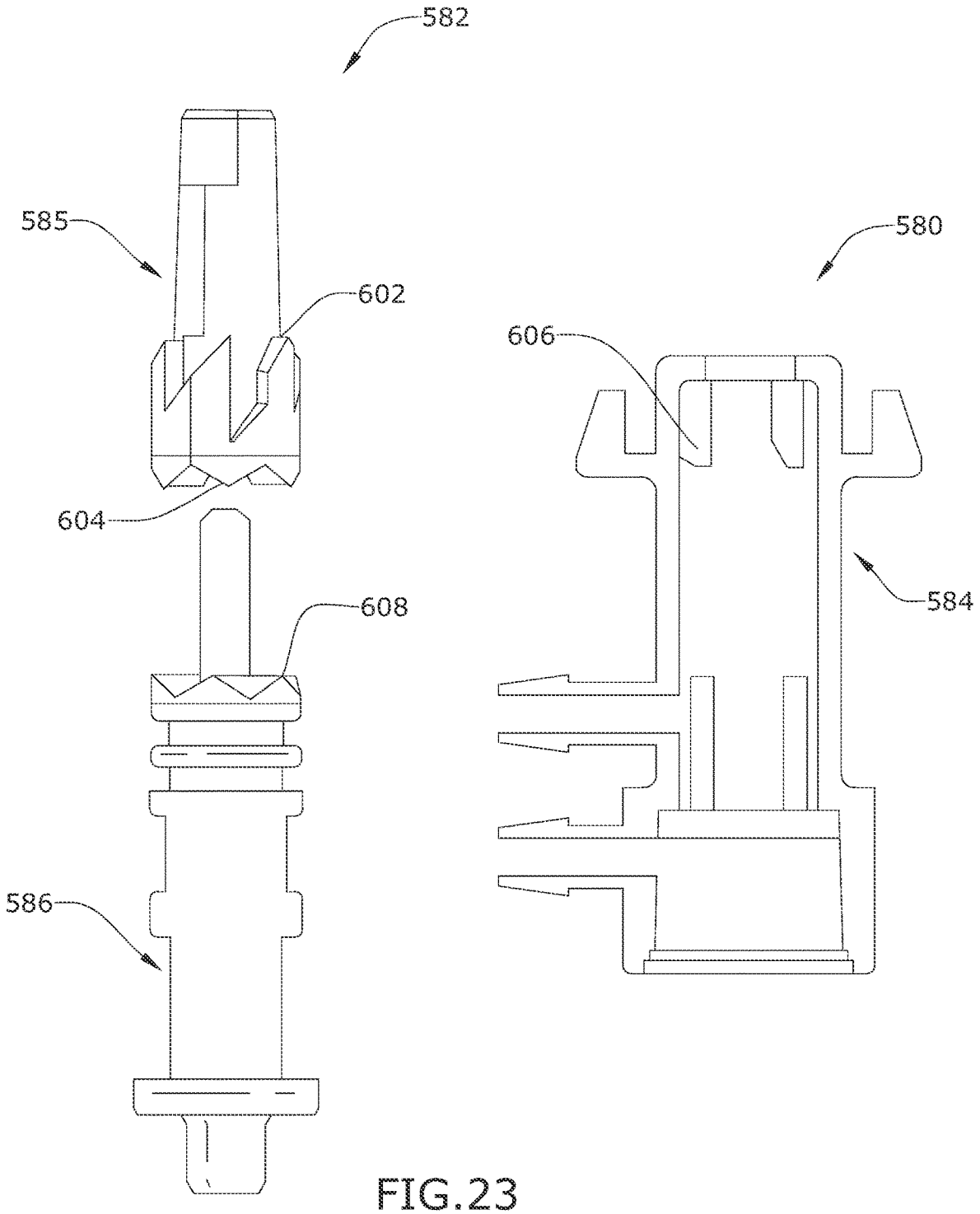
FIG. 23 is a partially exploded and partial sectional view through the valve of FIG. 21.

Referring to FIG. 23, the function of the valve assembly relies on cam interfaces between the plunger 585 and the valve body 584 and between the plunger 585 and the valve piston 586. The cam interfaces include an upper cam surface 602 and a lower cam surface 604 on the plunger 585, a cam surface 606 on the valve body 584 that corresponds to the upper cam surface 602 on the plunger 585, and a cam surface 608 on the valve piston 586 that corresponds to the lower cam surface 604 on the plunger 585. The cam interfaces are configured to rotate the plunger 585 during both a downward stroke and upward return stroke. A cam guide can be provided for guiding the movement of the valve piston 586 in a controlled manner; as shown, the cam guide can include one or more radial projections 610 from the valve piston which is received in a corresponding elongated slot 612 in the interior of the valve body.

The cam surfaces 602, 604, 606, 608 can include various cam profiles on the plunger 585, valve body 584, and valve piston 586. In one non-limiting aspect of the present disclosure, the cam interfaces are configured to rotate or index the plunger 585 a total of 60 degrees per cycle, each cycle comprising a downward and upward stroke of the plunger. The lower cam surface 604 of the plunger 585 is offset from the cam surface 608 on the valve piston 586 by 10 degrees and the remaining cam interfaces are configured such that on a downward stroke, the plunger 585 will rotate 20 degrees whereas on an upward stroke, the plunger 585 will rotate 40 degrees.

In operation, when the user or operator presses downward on the control pedal 575, the lower cam surface 604 on the plunger 585 will engage the cam surface 608 of the valve piston 586. As the downward motion continues, the upper cam surface 602 on the plunger 585 will clear the fixed cam surface 606 on the valve body 584. The interface between the plunger 585 and valve piston 586 will cause the plunger 585 to rotate. In the illustrated aspect of the present disclosure the plunger 585 rotates 20 degrees in a counterclockwise direction on the downward plunger stroke. When the pedal 575 is released, the spring force will cause the plunger 585 and valve piston 586 to move upward, however, the plunger 585 will be fixed in a lower position due to the interface between the upper cam surface 602 of the plunger 585 and the valve body 584. The valve piston 586 will not be able to return to its "seated" position, causing the valve 582 to stay open, as shown in FIG. 22. In the illustrated aspect of the present disclosure, the plunger 585 rotates 40 degrees in a counterclockwise direction on the upward plunger stroke. When the operator presses the control pedal 575 again, the same interaction between all the cam surfaces 602, 604, 606, 608 will repeat causing the plunger 585 to rotate another 20 degrees. When the pedal 575 is released, the interface between the upper cam surface 602 of the plunger 585 and the valve body 584 will rotate the plunger 585 another 40 degrees, allowing the valve piston 586 to return to its "seated" position and the valve 582 will close, as shown in FIG. 21.

When the valve 582 is open, a continuous spray of fluid will be provided by the nozzle flushing manifold 540 until the pedal 575 is pushed again. A mechanism can be provided for automatically turning off the spray from the nozzle flushing manifold 540 in case the pedal 575 is left in the "on" position. For example, a timer-controlled valve can be provided in the fluid pathway between the push-push valve 582 and the nozzle flushing manifold 540 which is configured to close after a predetermined amount of time.

Aspects of the present disclosure provide for a self-cleaning method for an extraction cleaner having a fluid supply container and a fluid distributor. The method includes docking an extraction cleaner in a cleaning tray having a recessed portion configured to sealingly receive a suction nozzle and an agitator of the extraction cleaner. The cleaning tray can also include an insert configured to engage the agitator. The method further includes rotating the agitator such that engagement with the insert scrapes debris from the agitator. Cleaning fluid can be distributed from the fluid supply container into the recessed portion via the fluid distributor, and the cleaning fluid can also be suctioned from the recessed portion into the extraction cleaner.

Optionally, the method can include rotating the agitator during either or both of the distributing cleaning fluid or suctioning cleaning fluid. Optionally, the method can include sensing via a controller when the docking is completed. In such a case, the cleaning fluid distribution can be performed automatically when the controller senses the docking is completed. Optionally, the method can include distributing cleaning fluid through a sealed cleaning pathway between a brush chamber and the suction nozzle of the extraction cleaner via the recessed portion.

There are several advantages of the present disclosure arising from the various features of the apparatus described herein. For example, aspects of the disclosure described above provide improved systems and methods for cleaning extraction cleaners. Extraction cleaners can get very dirty and can be difficult for the user to clean. The self-cleaning systems and method disclosed herein save the user considerable time, and may lead to more frequent use of the extraction cleaner.

Another advantage arising from the various features of the apparatus described herein is that the aspects of the disclosure described above provide a cleaning tray for an upright extraction cleaner. In particular, the brush chamber, brushrolls, and/or suction nozzle of an upright extraction cleaner can be cleaned by the cleaning tray. This can reduce the need for the user to manually remove the brushroll or suction nozzle for cleaning. The cleaning tray can take advantage of the fluid supply system of the extraction cleaner, which conventionally distributes cleaning fluid onto the surface to be cleaned, to spray cleaning fluid into the brush chamber to clean the brushroll automatically and without direct user inaction.

Yet another advantage arising from the various features of the apparatus described herein is that robotic extraction cleaners can be cleaned using a self-cleaning docking station. Prior robotic cleaners in need of cleaning have required the user to manually remove the brush, and rinse parts in the sink. Aspects of the present disclosure provide a docking station that can clean the brush chamber, brushroll, and/or suction nozzle of the robot when docked with the docking station according to an automatic cleaning cycle.

Yet another advantage arising from the various features of the apparatus described herein is that a nozzle flushing manifold can be provided for an extraction cleaner having a suction nozzle. The flushing manifold is mounted on the nozzle assembly and can take advantage of the fluid supply system of the extraction cleaner, which conventionally distributes cleaning fluid onto the surface to be cleaned, to spray cleaning fluid into the suction pathway to clean the suction nozzle automatically and without direct user inaction.

To the extent not already described, the features and structures of the various aspects of the present disclosure of the extraction cleaners, systems, and methods may be used in combination with each other as desired. That one feature may not be illustrated in all of the embodiments is not meant to be construed that it cannot be, but is done for brevity of description. Furthermore, while the extraction cleaners shown herein are upright or robot cleaners, features of the disclosure may alternatively be applied to canister-type, stick-type, handheld, or portable extraction cleaners. Still further, while the extraction cleaners shown herein deliver liquid cleaning fluid to the surface to be cleaned, aspects of the disclosure may also be incorporated into other extraction cleaning apparatus, such as extraction cleaning apparatus with steam delivery instead of or in addition to liquid delivery. Thus, the various features of the embodiments disclosed herein may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A cleaning tray for an extraction cleaner having a fluid delivery system, a suction nozzle, a brush chamber, and an agitator, the cleaning tray comprising:

a tray body configured to physically support a portion of the extraction cleaner;

a plurality of spray nozzles on the tray body configured to spray cleaning fluid toward at least one of the suction nozzle, the brush chamber, and the agitator of the extraction cleaner; and a fluid delivery pathway supplying cleaning fluid to the plurality of spray nozzles, the fluid delivery pathway comprising an inlet configured to fluidly couple with the fluid delivery system of the extraction cleaner;

wherein a portion of the fluid delivery pathway is one of formed in the tray body and mounted to the tray body.

2. The cleaning tray of claim 1 wherein the inlet comprises a hose receiver configured to fluidly couple with an accessory hose of the extraction cleaner.

3. The cleaning tray of claim 2 comprising a fluid delivery manifold defining the fluid delivery pathway, the fluid delivery manifold having a first end fluidly connected to the hose receiver.

4. The cleaning tray of claim 3 wherein the fluid delivery manifold comprises a plurality of conduits, each of the plurality of conduits extending from the hose receiver to one of the plurality of spray nozzles.

5. The cleaning tray of claim 4 wherein the plurality of conduits are integrally-molded with the tray body.

6. The cleaning tray of claim 4 wherein the plurality of spray nozzles are disposed on an upper side of the tray body, the plurality of conduits extend along a bottom of the tray body, and each of the plurality of conduits comprises an outlet fluidly coupled with one of the spray nozzles.

7. The cleaning tray of claim 6 wherein the plurality of conduits comprise flexible hoses fastened within a channel on a bottom of the tray body.

8. The cleaning tray of claim 2 wherein the hose receiver comprises a fluid connector coupler in fluid communication with the fluid delivery pathway and configured to fluidly couple with a fluid connector of the accessory hose.

9. The cleaning tray of claim 8 wherein hose receiver comprises an airflow connector coupler configured to receive an airflow connector of the of the accessory hose and to support the accessory hose in a substantially upright position on the tray body.

10. The cleaning tray of claim 8 comprising a valve actuator configured to open a valve of the accessory hose upon coupling of the fluid connector of the accessory hose with the fluid connector coupler.

11. The cleaning tray of claim 2 comprising a trigger actuator configured to depress a trigger of the accessory hose when the accessory hose of the extraction cleaner is fluidly coupled with the hose receiver.

12. The cleaning tray of claim 1 wherein each of the plurality of spray nozzles comprises at least one spray nozzle outlet oriented to direct a spray of cleaning fluid outward from the tray body.

13. The cleaning tray of claim 1 wherein the plurality of spray nozzles are disposed on an upper side of the tray body, each of the plurality of spray nozzles comprises at least one spray nozzle outlet oriented to direct a spray of cleaning fluid upwardly from the tray body.

14. The cleaning tray of claim 1 wherein the tray body is configured to create a sealed cleaning pathway between the brush chamber and the suction nozzle of the extraction cleaner, and the plurality of spray nozzles are configured to spray cleaning fluid toward the brush chamber and the agitator of the extraction cleaner.

15. The cleaning tray of claim 1 wherein the tray body comprises a forward support to engage the suction nozzle of the extraction cleaner and a rearward support to engage behind the brush chamber of the extraction cleaner.

16. The cleaning tray of claim 1 comprising a fluid delivery manifold defining the fluid delivery pathway, the fluid delivery manifold having a first end fluidly connected to the inlet, wherein the fluid delivery manifold comprises a plurality of conduits, each of the plurality of conduits extending to one of the plurality of spray nozzles.

17. A self-cleaning cleaning system comprising:

an extraction cleaner apparatus comprising a fluid delivery system, a suction nozzle, a brush chamber, and an agitator; and a cleaning tray comprising:

a tray body configured to physically support a portion of the extraction cleaner; and a plurality of spray nozzles on the tray body configured to spray cleaning fluid toward at least one of the suction nozzle, the brush chamber, and the agitator of the extraction cleaner; and a fluid delivery pathway supplying cleaning fluid to the plurality of spray nozzles, the fluid delivery pathway comprising an inlet configured to fluidly couple with the fluid delivery system of the extraction cleaner;

wherein a portion of the fluid delivery pathway is one of formed in the tray body and mounted to the tray body.

18. The self-cleaning cleaning system of claim 17 wherein:

the extraction cleaner comprises a supply container and an accessory hose in fluid communication with the supply container; and the inlet comprises a hose receiver configured to fluidly couple with the accessory hose of the extraction cleaner to supply cleaning fluid from the supply container to the cleaning tray.

19. The self-cleaning cleaning system of claim 17 wherein:

the cleaning tray comprises a fluid delivery manifold on an underside of the tray body and defining the fluid delivery pathway, the fluid delivery manifold having a first end fluidly connected to the inlet; and the plurality of spray nozzles are disposed on an upper side of the tray body, each of the plurality of spray nozzles comprising at least one spray nozzle outlet oriented to direct a spray of cleaning fluid upwardly from the tray body.

20. The self-cleaning cleaning system of claim 17 wherein:

the extraction cleaner comprises a recovery container in fluid communication with the suction nozzle;

the plurality of spray nozzles are configured to spray cleaning fluid toward the brush chamber and the agitator of the extraction cleaner; and the tray body creates a sealed cleaning pathway between the brush chamber and the suction nozzle of the extraction cleaner.

* * * * *